United States Patent [19]

Tanaka et al.

[11] Patent Number: 5,005,370

[45] Date of Patent: Apr. 9, 1991

[54] THERMAL EXPANSION VALVE

[75] Inventors: Hazime Tanaka, Yokohama; Teiichi Okamoto, Kawasaki; Kenji Yoshiga, Funabashi; Kazuhiko Watanabe, Sagamihara, all of Japan

[73] Assignee: Fuji Koki Mfg. Co. Ltd., Tokyo, Japan

[21] Appl. No.: 452,426

[22] Filed: Dec. 19, 1989

[30] Foreign Application Priority Data

Dec. 19, 1988 [JP] Japan ..... 63-318549

[51] Int. Cl.[5] ..... F25B 41/00

[52] U.S. Cl. ..... 62/211; 62/504

[58] Field of Search ..... 62/211, 504

[56] References Cited

U.S. PATENT DOCUMENTS

| | | | |
|---|---|---|---|
| 2,538,861 | 1/1951 | Carter | 62/211 |
| 2,701,451 | 2/1955 | Candor | 62/211 |
| 3,196,630 | 7/1965 | Barbier | 62/210 X |
| 4,242,116 | 12/1980 | Aschberger et al. | 62/504 X |

*Primary Examiner*—Lloyd L. King

*Attorney, Agent, or Firm*—Joseph Scafetta, Jr.

[57] ABSTRACT

In a thermostatic expansion valve having a thermo bulb, a valve opening degree is defined by the force difference between a first force at one side surface of a diaphragm and a second force at the other side surface thereof. The former force is the sum of the pressure of a refrigerant, sensed at the downstream side of a valve seat and applied on one side surface by an auxiliary pressure applying capillary tube, and the biasing force, applied on one side surface by a valve body spring. The latter force is the sum of the pressure of an actuator vapor, contained in a thermal bulb and applied on the other side surface of the diaphragm, and the pressure of the refrigerant, sensed at the upstream side of the valve seat in a refrigerant pathway of a valve housing and applied on the other side surface by way of a force transmitting member. Parameters for the former and latter forces are so selected that the latter becomes bigger than the former so that a refrigerant can be supplied at a flow rate over a predetermined value to an evaporator, even when the value of a superheat degree is lower than the value of a predetermined set static superheat degree in a case where the difference in the pressure of the refrigerant exerted on the valve body between a first pressure sensed at the upstream side of the valve seat and a second pressure sensed at the downstream side thereof is larger than a pressure difference which is used as a base for setting the static superheat of the thermostatic expansion valve.

8 Claims, 15 Drawing Sheets

THERMAL EXPANSION VALVE

BACKGROUND OF THE INVENTION

1. Field of the Invention

This invention relates to a thermostatic expansion valve to be used as an expansion means for a refrigerating system comprising also a compressor, a condenser and an evaporator and using a refrigerant for heat exchange. More particularly, the invention relates to a thermostatic expansion valve which normally controls the extent of a valve opening to keep the degree of superheat at a predetermined level so that the efficiency of the evaporator is kept at a high level and makes the refrigerant flow into the evaporator at a predetermined flow rate when the evaporating temperature of the refrigerant in the evaporator is low.

2. Description of the Related Art

FIG. 1 schematically shows the configuration of a typical conventional refrigerating system used in an air conditioner. In this system, an evaporator 10, a compressor 12, a condenser 14, a reservoir 16 and a thermostatic expansion valve 18, which is used as the expansion means, are serially connected by a single duct line 20 in the above mentioned order and the thermostatic expansion valve 18 and the evaporator 10 are further connected by the duct line 20 to form a closed loop.

The refrigerant in the closed loop is vaporized in the evaporator 10 by exchanging heat with ambient air. The refrigerant is liquidized in the condenser 14 by exchanging heat with ambient air after it is compressed in the compressor 12, and reaches the thermostatic expansion valve 18 by way of the reservoir 16. The pressure of the compressed and liquidized refrigerant is reduced by the expansion valve 18 so that the refrigerant can easily evaporate in the evaporator 10.

The thermostatic expansion valve 18 has a thermal bulb 22 located at the outlet of the evaporator 10, and the actuator vapor contained in the thermal bulb 22 changes its state from vapor to liquid or vice versa in response to the temperature of the superheated vapor of the refrigerant at the outlet of the evaporator 10. Any changes in the pressure of the actuator vapor due to its vapor liquid transformation are applied to the upper surface of a diaphragm housed in a valve-body driving chamber which is mounted in the upper portion of the thermostatic expansion valve 18, so that the diaphragm is displaced in the valve-body driving chamber. Since a valve body is connected with the lower surface of the diaphragm, the displacement of the diaphragm changes the degree of the valve opening of the valve body.

When the difference between the evaporation temperature of the refrigerant contained in the evaporator 10 and the temperature of the superheated vapor of the refrigerant at the outlet of the evaporator 10 (hereinafter referred to as the degree of superheat) exceeds a predetermined value (hereinafter referred to as the degree of static superheat), the thermostatic expansion valve 18 displaces the valve body from its closure position, and after that, the expansion valve 18 controls the flow rate of the refrigerant flowing into the inlet of the evaporator 10 so as to make the degree of superheat always take a predetermined value larger than the degree of static superheat. When the degree of superheat takes the above described predetermined value, the evaporator 10 operates with an optimum efficiency; therefore the above described predetermined value of the degree of superheat is called the degree of working superheat.

On the other hand, however, there are other requirements in the refrigeration system used for airconditioning of an automobile.

That is, there are requirements for the refrigeration system to be so designed that the thermostatic expansion valve does not move the valve body to the closed position in order that the refrigerant is kept flowing into the evaporator 10, even in a case where the degree of superheat (signal) is small while the evaporation pressure (or the evaporation temperature) is low.

The above described requirements follow.

(1) In order to prevent the outer surface of the evaporator from being covered with frost (or being frozen) while the evaporation pressure and the evaporation temperature is low, a great amount of the refrigerant is needed to flow into the evaporator to keep the evaporator flooded with the refrigerant.

Covering the evaporator with frost impairs the working efficiency of the evaporator.

(2) In a case where a variable capacity compressor (a compressor which senses the evaporation pressure and controls its capacity to lower it when the evaporation pressure is low) is used, in order to prevent the action of the variable capacity compressor from being unstable while a heat load becomes small, a small constant amount of the refrigerant is needed to flow into the evaporator.

When the heat load becomes small, the thermostatic expansion valve moves its valve body between the opening position and the closed position with short intervals owing to the original function of the valve, so that the evaporation pressure signal sensed by the variable capacity compressor becomes unstable to make the action of the compressor unstable.

These requirements are proper in circumstances where the compressor will not be damaged even if the liquid back flow phenomenon is produced in the compressor since rotary-type compressors are widely used in the small-sized refrigeration systems for air conditioners of the automobiles.

The following inventions are prior art devices which are employed to realize the above described requirements.

In one of the prior art devices, a notch or a bleed port is provided in a valve seat.

In this prior art, a passage way for flowing a refrigerant at a predetermined flow rate (a function of a pressure difference between a high pressure side and a low pressure side) is provided in addition to the construction for the thermostatic expansion valve, so that the refrigerant can flow at the predetermined flow rate even when the thermostatic expansion valve is closed.

The above described prior art, has a disadvantage in that the original ability of the thermostatic expansion valve is impaired because the refrigerant is a given amount, not relating to the control of the thermostatic expansion valve, flows even in a case where the thermostatic expansion valve must function as originally intended.

Actually, with this prior art, the above described requirements are not fully satisfied.

Another prior art device is disclosed in Published Unexamined Japanese Utility Model Application No. 61-153875, in which a special expansion valve with an additional function is discussed.

The construction of this special expansion valve is schematically shown in FIG. 2.

The valve-body driving mechanism of this special expansion valve is constructed by two main portions, a first valve-driving mechanism 26 which is constituted by a combination of a thermal bulb 22 and a diaphragm 24 and operates in the same way as the valve-body driving mechanism of the above described conventional thermostatic expansion valve when the evaporation temperature is high and the evaporation pressure is also high, and a second valve-body driving mechanism 30 which is located between the diaphragm 24 of the first valve-body driving mechanism 26 and a valve body 28 and operates as a constant pressure expansion valve, which is different from the above described thermostatic expansion valve, when the evaporation temperature is low and the evaporation pressure is lower than a predetermined constant value.

The second valve-body driving mechanism 30 has a diaphragm 32 which is located nearer to the valve body 28 than the diaphragm 24 of the first valve-body driving mechanism 26 so that a constant pressure expansion chamber 34 is formed between the diaphragm 32 and the diaphragm 24 of the first valve-body driving mechanism 26. The constant pressure expansion chamber 34 contains an actuator vapor whose pressure is kept at a predetermined level and is provided with a force transmitting member 36 having its two opposite ends abutted on the diaphragm 24 and the diaphragm 32. Outside the constant pressure expansion chamber 34, a diaphragm carrier 38 abutts the diaphragm 32, the carrier 38 is connected with a spring carrier 42 for carrying a spring 40 designed to bias the valve body 28 toward the closure position, by a connecting rod 44.

When the evaporation temperature and the evaporation pressure are high in the evaporator 10 of the thermostatic expansion valve having a construction as described above, as in the same way as a conventional thermostatic expansion valve, the valve body 28 is driven by only the pressure of the actuator vapor contained in the thermal bulb 22 of the valve-body driving mechanism 26 because, the pressure of the actuator vapor in the thermal bulb 22 of the first valve-body driving mechanism 26 applied on the diaphragm 24 becomes larger than that of the actuator vapor in the constant pressure expansion chamber 34 of the second valve-body driving mechanism 30.

On the contrary, when the evaporation temperature is low and the evaporation pressure is lower than a constant value in the evaporator 10, the valve body 28 is driven by only the pressure of the actuator vapor in the constant pressure expansion chamber 34 of the second valve-body driving mechanism 30 because the pressure of the actuator vapor in the thermal bulb 22 of the first valve-body driving mechanism 26 applied on the diaphragm 24 becomes lower than the pressure of the actuator vapor in the constant pressure expansion chamber 34 of the second valve-body driving mechanism 30. That is to say, this special expansion valve does not act as the above described conventional normal thermostatic expansion valve which acts as a constant pressure expansion valve. Consequently, the valve body 28 is moved to its open position regardless of the value of the degree of superheat.

The above described special expansion valve is effective in principle for solving the above listed two problems in the above described refrigerating systems, but a number of problems as described below arise when it is manufactured.

Firstly, the force transmitting member 36 and the constant pressure expansion chamber 34 must be worked with a high precision in order to make the force transmitting member 36 faithfully respond to small changes in the pressure of the actuator vapor contained in the thermal bulb 22.

Secondly, the constant pressure expansion chamber 34 is formed to have a large volume in order to prevent the action of the valve body 28 driving in the second valve-body driving mechanism 30 from being influenced by the change in the volume of the constant pressure expansion chamber 34 that is caused by the displacement of the diaphragm 24 due to fluctuation of the pressure of the actuator vapor in the first valve-body driving mechanism 26.

Thirdly, a relatively large plane area is required for the diaphragm 24 in order to drive that valve body 28 in the first valve-body driving mechanism 26 because the pressure of the actuator vapor produced in the, first valve-body driving mechanism 26 is low. Since the diaphragm 24 having a large plane area increases the displacement of caused by fluctuations in the pressure of the actuator vapor in the first valve-body driving mechanism 26, the constant pressure expansion chamber 34 must be formed to have a large volume in order to solve the above described second problem. Therefore, the outer dimensions of the expansion valve of the above described known type become large.

Fourthly, the above described expansion valve uses two diaphragms which require troublesome mounting processes.

SUMMARY OF THE INVENTION

This invention is contrived from the above described circumstances. Therefore, an object of the present invention is to provide a thermostatic expansion valve which is free from the above described various problems that arise in the above described known expansion valve which operates in the same way as the conventional thermostatic expansion valve when the evaporation temperature is high and the evaporation pressure is higher than the predetermined constant pressure value in the evaporator and which acts differently from the conventional thermostatic expansion valve to supply the refrigerant to the evaporator when the evaporation temperature is low and the evaporation pressure is lower than a predetermined value.

In order to achieve the above object of the invention, a first embodied thermostatic expansion valve of this invention to be used in a refrigerating system having a compressor, a condenser, an evaporator and an expansion means, using a refrigerant for heat exchange, comprises: a valve housing having a refrigerant pathway in which a valve seat is formed and also having a diaphragm chamber in which a diaphragm is housed; a valve body arranged in the valve housing so as to be movable between a closure position where it is in contact with the valve seat and an open position where it is separated from the valve seat, said valve body being connected with one side surface of the diaphragm so as to be moved between the closure position and the open position in accordance with the displacement of the diaphragm; biasing means provided in the valve housing for biasing the valve body toward the closure position; auxiliary pressure applying means for applying the pressure of the refrigerant, sensed at the downstream side of the valve seat, on one side surface of the diaphragm; and principal pressure applying means having a thermal bulb which contains an actuator vapor and is located at the outlet of the evaporator, for applying the pressure of the actuator vapor, which is responding to the temperature at the outlet of the evaporator, on the other side surface of the diaphragm; and valve body biasing pressure means provided on the valve body so as to bias the valve-body from the closure position toward the open position by means of the pressure of the refrigerant sensed at the upstream side of the valve seat in the refrigerant pathway of the valve housing.

A second embodied thermal expansion valve of this invention comprises: a valve housing having a refrigerant pathway in which a valve seat is formed and also having a diaphragm chamber in which a diaphragm is housed; a valve body arranged in the valve housing so as to be movable between a closure position where it is in contact with the valve seat and an open position where it is separated from the valve seat, said valve body being connected with one side surface of the diaphragm so as to be moved between the closure position and the open position in accordance with the displacement of the diaphragm; biasing means provided in the valve housing for biasing the valve body toward the closure position; auxiliary pressure applying means for applying the pressure of the refrigerant sensed at the downstream side of the valve seat on one side surface of the diaphragm; a thermal bulb containing an actuator vapor and being arranged adjacent to and integrally with the diaphragm chamber so as to apply the pressure of the actuator vapor to the other side surface of the diaphragm; valve-body biasing pressure means mounted on the valve body so as to bias the valve body from the closure position toward the open position by means of the pressure of the refrigerant at the upstream side of the valve seat in the refrigerant pathway of the valve housing; and a joint block having a refrigerant inflow pathway communicated with the refrigerant inlet of the evaporator and a refrigerant outflow pathway communicated with the refrigerant outlet of the evaporator, said joint block containing the valve housing integrated with the thermal bulb, so that a refrigerant pathway of the valve housing is arranged in the refrigerant inflow pathway and the thermal bulb is arranged in the refrigerant outflow pathway.

With the first and second embodied thermostatic expansion valve according to the present invention constructed as described above, it is maintained that the degree of the valve opening of the thermostatic expansion valve is controlled by a difference between a pressure applied on one side surface of the diaphragm and a pressure applied on the other side surface thereof, in the normal, condition.

In a case where the pressure difference of the liquid refrigerant is big when the liquid refrigerant passes through a pathway constructed by the valve body and the valve seat (that is, it is a case where the evaporating temperature of the evaporator is lower than the evaporating temperature which is assumed when the degree of the static superheat of the thermostatic expansion valve is set), however, it is required that the degree of the actual valve opening becomes sufficiently larger than the designated value of the degree of the valve opening by the signal of the superheat degree (signal for designating the degree of the valve opening based on the degree of the superheat) when the valve body is loaded with the force of the flow of the fluid (liquid refrigerant).

The above described requirement is achieved by setting the diameter of the diaphragm (a factor which controls the force for the valve opening) and the diameter of the valve port (a factor which defines the force, loaded on the valve body by the flow of the fluid, and the flow rate of the refrigerant) by means of the following formula (A), and making the valve body has a circular truncated cone shape.

$$\psi(\delta,\Delta P)+\pi/4(PH-PL)\{(D_1^2-D_2^2)-4C_1LD_1\sin 2\theta_2\}-(Fo+KsL)=0 \quad (A)$$

where:

$\psi(\delta,\Delta P)$—force $F_1$ with which the diaphragm pushes the valve body, that is $F_1=\psi(\delta,\Delta P)$ where $F_1$ is a function of a pressure value $\Delta P$ which is converted from the degree of superheat and the deflection $\delta$ of the diaphragm;

PH—the saturated pressure of the refrigerant at the condensing temperature;

PL—the saturated pressure of the refrigerant at the evaporating temperature;

$D_1$—the diameter of the central bore of the valve seat;

$D_2$—the diameter of the force transmitting member having a circular cross section ($D_2 \rightarrow 0$ is assumed when the force transmitting member is obviously not subjected to the force of the flow refrigerant at the upstream side of the valve seat in the refrigerant pathway and when $D_2 \rightarrow 0$ is assumed, the propulsive force to move the valve body from the closure position to the open position, generated by the difference between the pressure PH of the refrigerant found at the upstream side of the valve seat in the refrigerant pathway of the valve housing and the pressure PL of the refrigerant sensed at the downstream side of the valve seat in the refrigerant pathway of the valve housing, becomes a maximum);

$C_1$—the flow coefficient of the refrigerant in the refrigerant pathway in the valve housing;

L—the distance over which the valve body is axially moved from its closure position to its open position;

$\theta_2$—a half of the taper angle of the valve-seat abutting portion of the valve body;

Fo—the preliminary load determined on the basis of design considerations and applied by the valve-body biasing means; and Ks—the coefficient for determining the biasing force generated by the valve-body biasing means, said biasing force increasing as the distance L of displacement of the valve body becomes greater.

The thermostatic expansion valve constructed as described above can supply a predetermined amount of refrigerant to the evaporator when the degree of superheat is small even in the low evaporating temperature area.

In the first and second thermostatic expansion valves made according to the present invention and constructed as described above, it is preferable that the valve-seat abutting portion of the valve body is located at the downstream side of the valve seat in the refrigerant pathway of the valve housing, and has a circular truncated cone with its top orientating toward the upstream side of the flow of the refrigerant in the refrigerant pathway. The valve-body biasing pressure means also has another circular truncated cone formed adjacent to and at the upstream side of the valve-seat abutting portion of the valve body with its top orientating toward the upstream side. The taper angle of the circular truncated cone of the valve-body biasing pressure means is smaller than that of the circular truncated cone of the valve body.

With the construction described above, a value of $\partial Q/\partial \Delta P$ (a ratio of the increasing rate of the flow rate Q of the refrigerant at the valve seat to the variation $\Delta P$ in the degree of superheat) can be smaller than that in a case where the taper angle of the peripheral surface of the circular truncated cone of the valve-body biasing pressure and the peripheral surface of the circular truncated cone of the valve-seat abutting portion of the valve body are equal to each other and both the peripheral surfaces are continuously and integrally formed. Therefore, the above described characteristics in the low evaporating temperature area are maintained, and further the suitable flow rate can be set in relation to the changes in the degree of the superheat.

A refrigerating system using the thermostatic expansion valve according to the invention operates most effectively when a half of the taper angle of the circular truncated cone of the valve-seat abutting portion of the valve body is approximately equal to $\pi/4$.

DETAILED DESCRIPTION OF THE PREFERRED EMBODIMENTS

Various embodiments of the invention will be described in detail with reference to the accompanying drawings.

Figure 1:
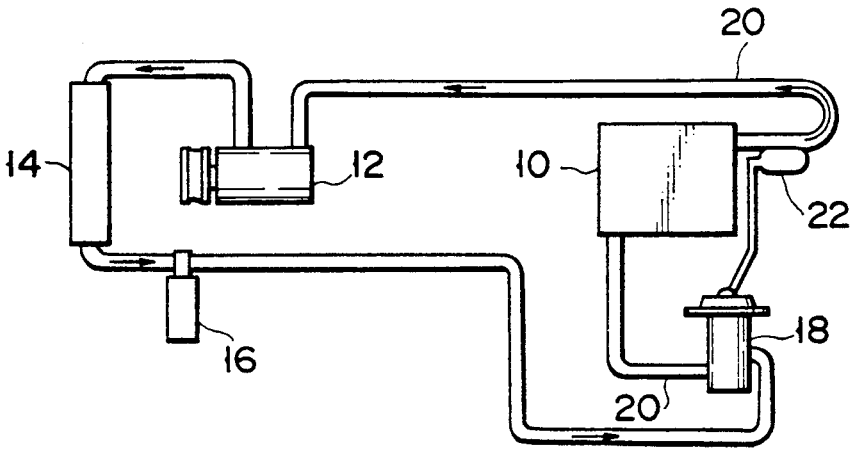
(PRIOR ART) FIG. 1
FIG. 1 is a schematic view showing a conventional refrigerating system that uses refrigerant for heat exchange.
Figure 2:
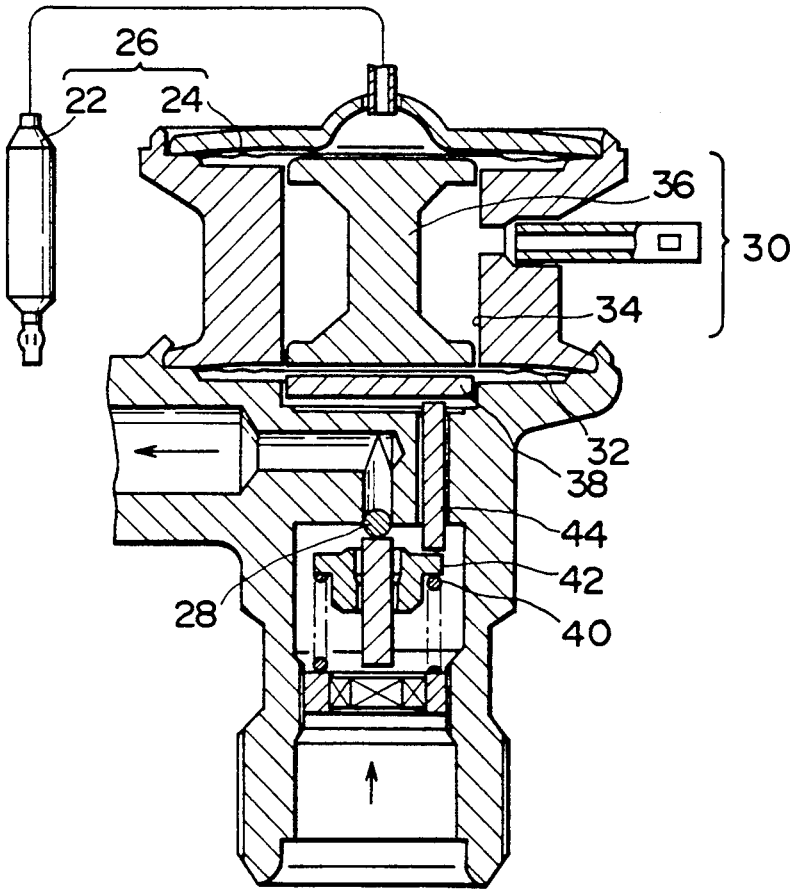
(PRIOR ART) FIG. 2
FIG. 2 is a schematical longitudinal sectional view of a conventional special expansion valve used in relatively small refrigerating systems, said special expansion valve operating as a normal expansion valve when the evaporation pressure exceeds a predetermined value and operating as a constant pressure expansion valve when the evaporation pressure lowers that predetermined value.
Figure 3:
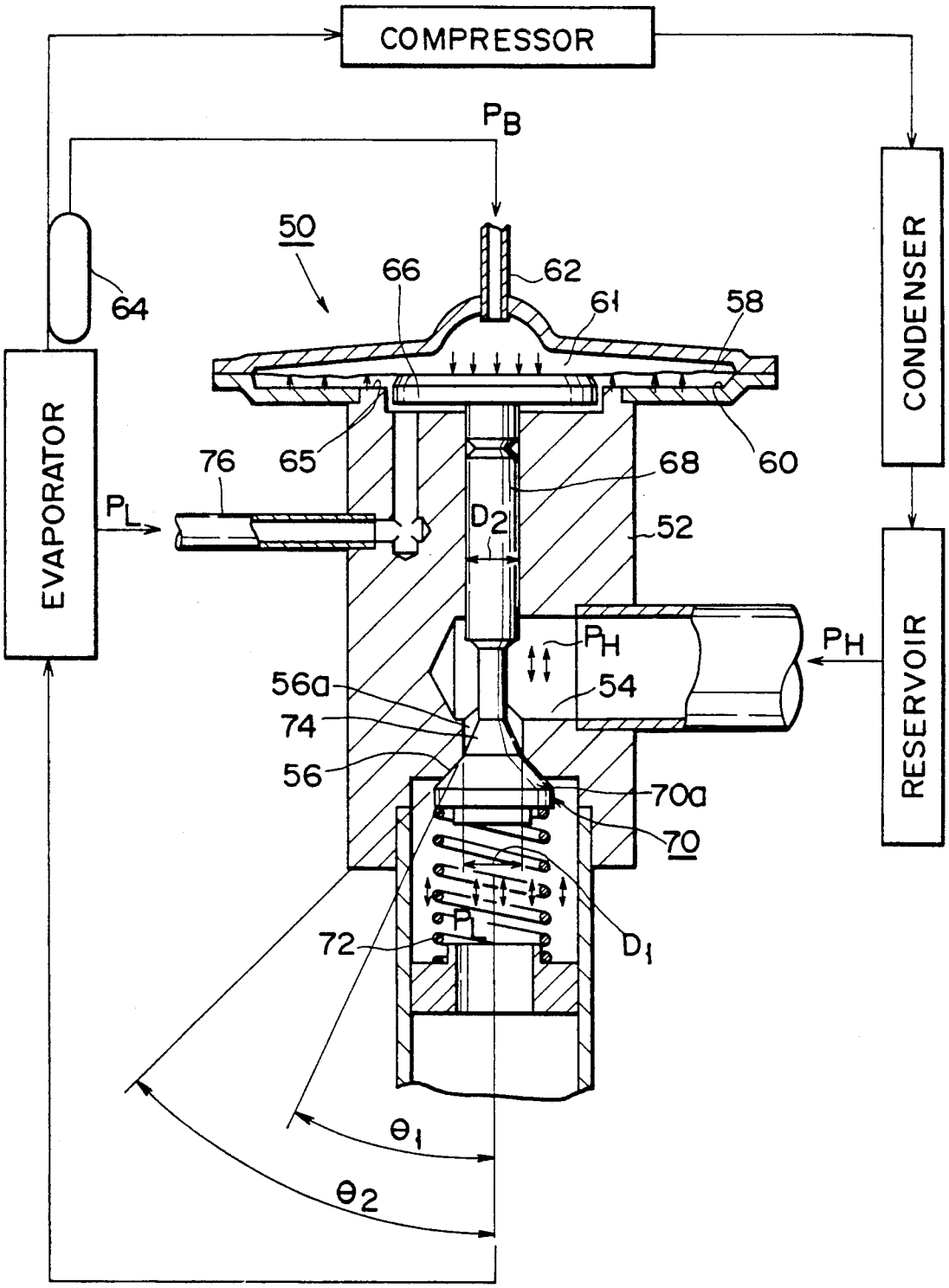
FIG. 3 is a longitudinal sectional view schematically showing a first embodiment of the present invention that is used in place of the conventional expansion valve shown in FIG. 2.

FIG. 3 schematically shows a longitudinal section of a thermostatic expansion valve 50 according to a first embodiment of this invention, which is used as an expansion means in a refrigerating system comprising a compressor, a condenser, an evaporator, and the expansion means, using refrigerant for heat exchange.

A substantially inverted L-shaped refrigerant pathway 54 is formed in a valve housing 52 of a thermostatic expansion valve 50 to open at its two opposite ends on the peripheral surface and the lower end surface of the housing. A valve seat 56 is formed in the refrigerant pathway 54 so as to be coaxial with the valve housing 54, and the valve seat 56 orients itself toward the opening of the refrigerant pathway 54 located at the lower end surface of the valve housing 52. The opening of the refrigerant pathway 54 at the lower end surface of the valve housing 52 is communicated with the inlet of the evaporator while that of the refrigerant pathway 54 at the peripheral surface of the refrigerant pathway 54 is communicated with the condenser by way of a reservoir.

A diaphragm chamber 60 in which a diaphragm 58 is housed is formed at the upper end portion of the valve housing 52. The diaphragm 58 in the diaphragm chamber 60 is coaxial with the valve housing 52 and perpendicular to its longitudinal center line. A number of concentric waves are formed on the outer peripheral portion of the diaphragm 58 in order to attain a desired degree of deflection of the diaphragm. The upper half space (main pressure applying chamber) 61 of the diaphragm chamber 60 is communicated with a thermal bulb 64 of a known construction by way of a capillary bulb 62. The thermal tube 64 is placed at the outlet of the evaporator, and the actuator fluid contained in the thermal bulb 64 is vaporized depending on the temperature of said outlet. Pressure PB of the vaporized actuator fluid is applied on the diaphragm 58 in the main pressure applying chamber 61.

A diaphragm carrying member 66 which coaxially abuts the undersurface of the diaphragm 58 is housed in the lower half space (auxiliary pressure applying chamber) 65 of the diaphragm chamber 60. The diaphragm carrying member 66 is connected with the upper end of a generally columner force transmitting member 68 which is coaxially extended from the central bore 56*a* of the valve seat 56 along said longitudinal center line in the valve housing 52.

A valve body 70 is integrally formed with the lower end of the force transmitting member 68 at the downstream side of the valve seat 56 in the refrigerant pathway 54. The valve body 70 has a circular truncated cone shape with its top being oriented toward the upstream side, and its peripheral surface is a valve-seat abutting portion 70*a* that tightly abuts the valve seat 56.

The valve body 70 is biased to its closure position by a compressive coil spring 72 which acts as biasing means arranged downstream side of the valve seat 56 in the refrigerant pathway 54, so that the valve-seat abutting portions 70*a* tightly abuts the valve seat 56 in the valve housing 52.

A valve-body biasing pressure portion 74 is further formed on the lower end of the force transmitting member 68 at the upstream side of the valve body 70. The valve-body biasing pressure portion 74 is located in the central bore 56*a* in which the valve seat 56 is seated, and has a circular truncated cone shape with its top being oriented toward the upstream side just like the valve-seat abutting portion 70*a*.

In this embodiment, the value $\theta_1$ of a half of the taper angle of the valve-body biasing pressure portion 74 is smaller than the value $\theta_2$ of a half of the taper angle of the valve seat abutting portion 70*a*.

The auxiliary pressure applying chamber 65 of the diaphragm chamber 60 is communicated with the evaporator by way of a capillary tube 76. The capillary tube 76 applies vapor pressure PL of the refrigerant in the evaporator on the diaphragm 58 from the side of the auxiliary pressure applying chamber 65.

In the above described embodiment, any excessive deflection that may be generated on the diaphragm 58 in the diaphragm chamber 60 is effectively restricted by the upper wall of the diaphragm chamber 60 and the diaphragm carrying member 66.

In the first embodiment of the invention constructed as described above, force $F_1$ with which the diaphragm 58 pushes the valve body 70 can be approximately defined as a function of differential pressure $\Delta P$ ($=PB-PL$) and deflection $\delta$ of the diaphragm, and expressed by the following equation:

$$F_1=\psi(\delta,\Delta P). \quad (1)$$

Then, propulsive force $F_2$, exerted on the valve body 70 when the conical valve body 70 is separated from the valve seat 56 and when the refrigerant flows through the central bore 56*a* of the valve seat 56, can be approximately defined in the following manner:

$$F_2=-4\cdot C_1\cdot L\cdot D_1\cdot \sin(2\cdot\theta_2)\cdot(PH-PL) \quad (2)$$

where:

$C_1$ is the flow coefficient of the refrigerant in the refrigerant pathway 54 in the valve housing 52;

L is the distance over which the valve body 70 is axially moved from its closure position to open the valve;

$D_1$ is the diameter of the central bore 56a in which the valve seat 56 is seated;

$\theta_2$ is a half of the taper angle of the valve-seat abutting section 70a of the valve body 70;

PH is the saturated pressure of the refrigerant at the condensing temperature; and PL is the saturated pressure of the refrigerant at the evaporating temperature.

The following equation for static equilibrium of a thermostatic expansion valve according to the invention is derived from the above described equations (1) and (2):

$$\psi(\delta,\Delta P)+\pi/4(PH-PL)\{(D_1^2-D_2^2)-4C_1LD_1\sin 2\theta_2\}-(Fo+KsL)=0 \quad (3)$$

where:

$D_2$ is the diameter of the force transmitting member 36 having a circular cross section;

Fo is the preliminary load determined on the basis of design considerations and applied by the valve-body biasing means 72; and Ks is the coefficient for determining the biasing force generated by the valve-body biasing means 72, said biasing force increasing as the distance L of displacement of the valve body 70 becomes greater.

Figure 4A:
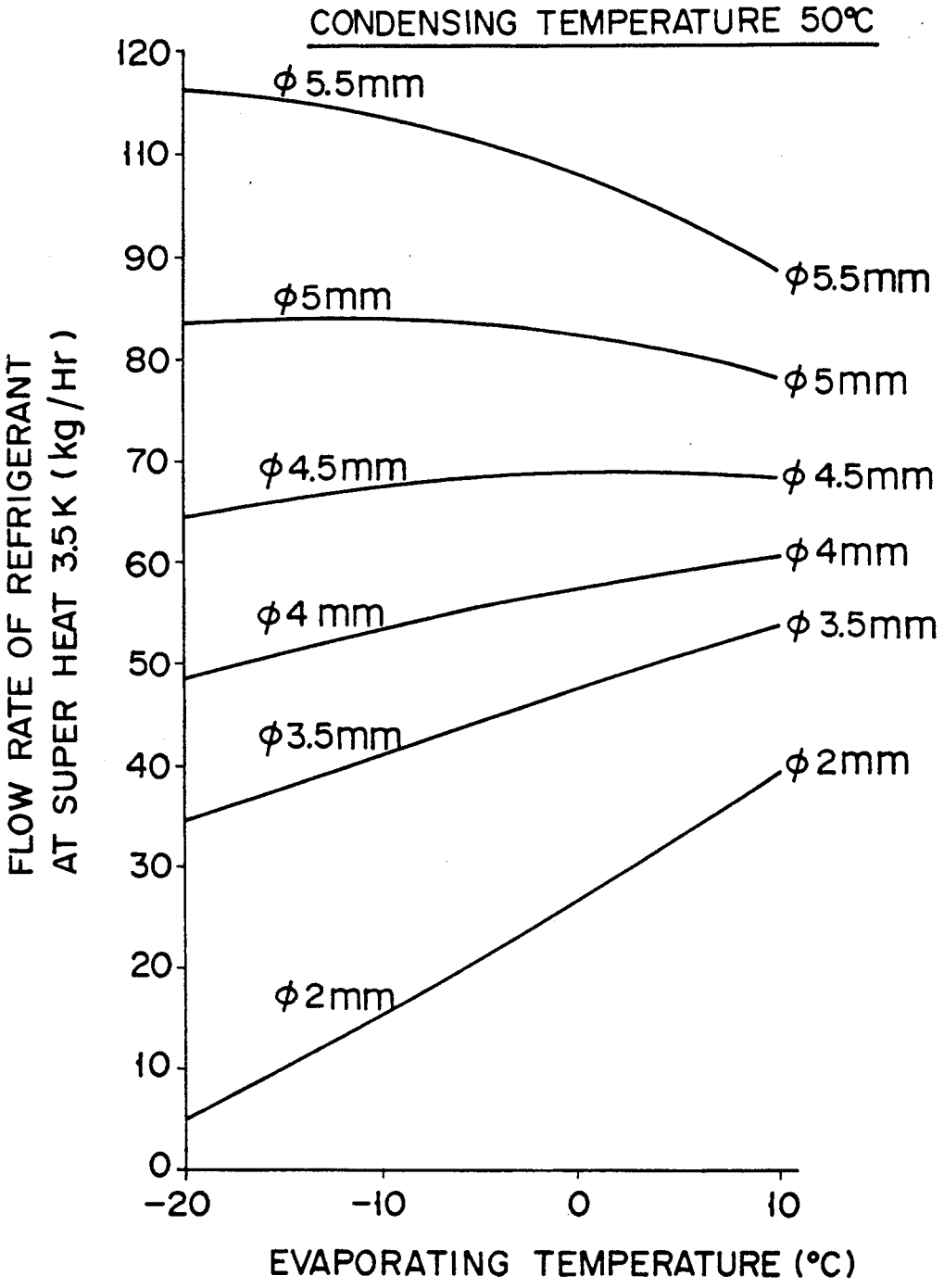
FIGS. 4A through 4C are graphs showing the relationship between the evaporating temperature of the refrigerant in the evaporator and the flow rate of refrigerant passing through the central bore of the valve seat, said graphs being obtained by plotting the values calculated under an assumption that the degree of superheat is 3.5 K, for different diameters of the central bore of the valve seat in a refrigerating system using the first embodiment when the condensing temperatures are respectively 50° C., 40° C. and 30° C.; in these graphs, it should be noted that the force of the flowing refrigerant exerted on the force transmitting member at the upstream side of the valve seat in the refrigerant pathway of the valve housing is disregarded, that R-13 is used as the system refrigerant and as the actuator fluid in the thermal bulb of the thermostatic expansion valve, that a half value of the taper angle of the valve-body biasing pressure portion is so selected as to make the open area in the central bore of the valve seat, corresponding to the distance of displacement of the valve body from the closure position toward the fully open position, to be constant regardless of the variation of the diameter of the central bore of the valve seat, and that the degree of static superheat is set at 3.155 K.
Figure 4B:
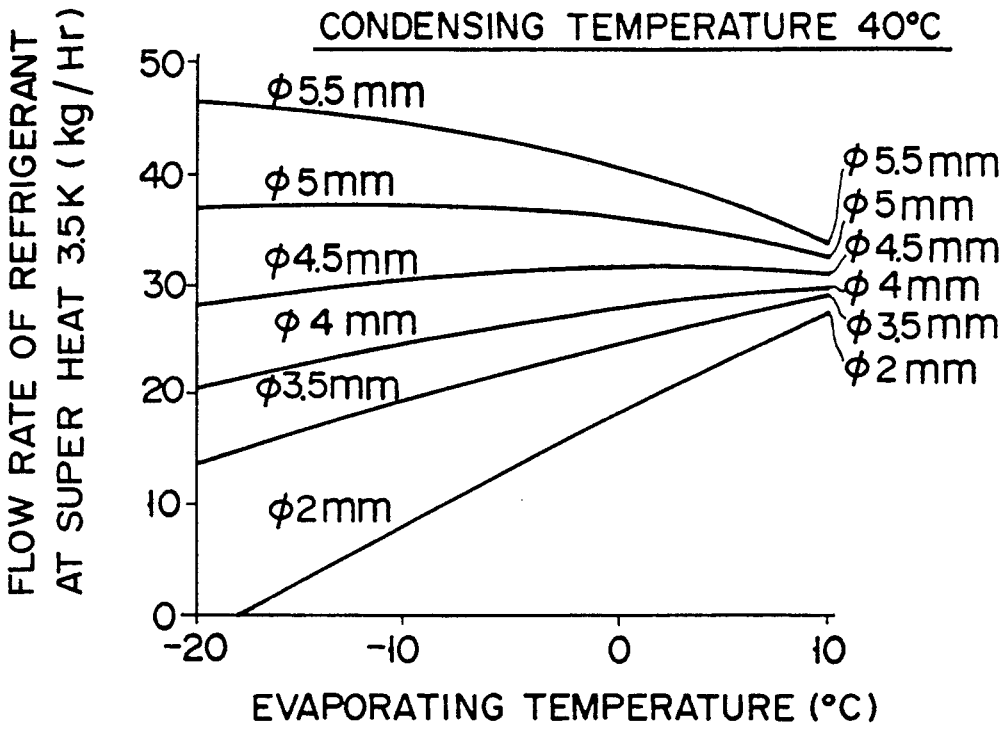
Figure 4C:
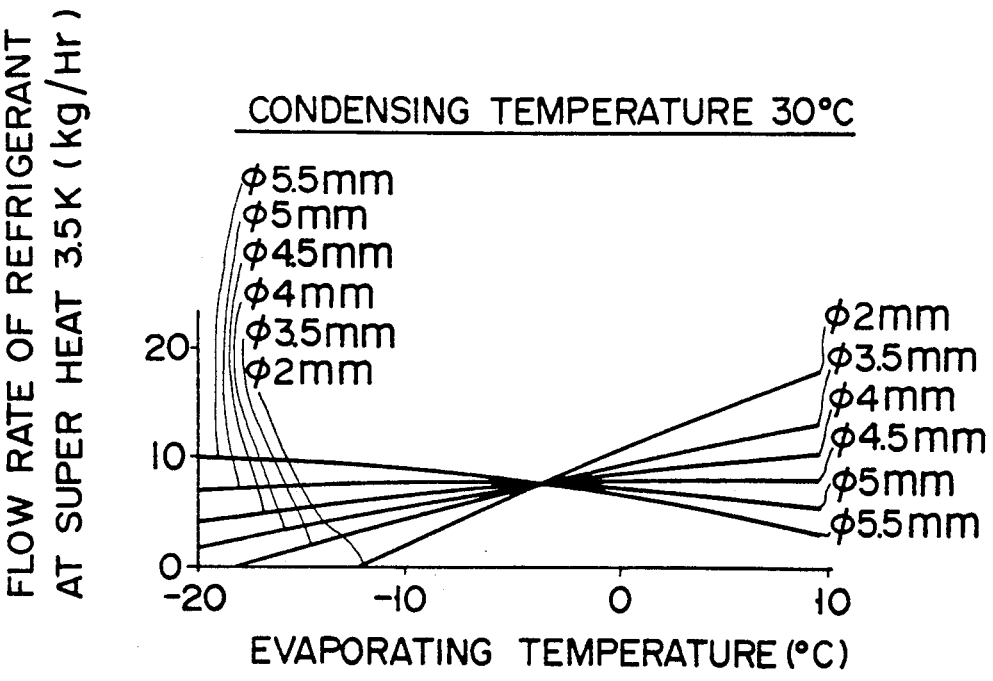

FIGS. 4A through 4C show the calculated values of the flow rate of the refrigerant passing through the central bore 56a of the valve seat 56 that varies with the variation in diameter $D_1$ of the central bore 56a of the valve seat 56 and with the variation in the evaporating temperature of the refrigerant when the condensing temperatures of 50° C., 40° C. and 30° C. are respectively assumed and the degree of superheat is 3.5 K under the following conditions.

(a) Diameter $D_2$ of the force transmitting member 68 is assumed to be 0. (This means that the force transmitting member 68 is not loaded with a remarkably large force of the flow of refrigerant at the upstream side of the valve seat 56 in the refrigerant pathway 54 of the valve housing 52. If $D_2$ is 0, the propulsive force, generated by the differential pressure between pressure PH of the refrigerant at the upstream side of the valve seat 56 in the refrigerant pathway 54 of the valve housing 52 and pressure PL of the refrigerant at the downstream side of the valve seat 56 in the refrigerant pathway 54 to move the valve body 70 toward its open position, takes its maximum value.)

(b) R-13 is used for both the refrigerant in the refrigerating system and the actuating fluid sealed in the thermal bulb 64.

(c) The diaphragm 58 is made of beryllium copper alloy and has a thickness of 0.10 mm and a diameter of 22 mm.

(d) The value $\theta_1$ of a half of the taper angle of the valve-body biasing pressure portion 74 is so selected that the open area attained, corresponding to the distance L over which the valve body 70 is moved toward its open position, can keep constant even when diameter $D_1$ of the central bore 56a of the valve seat 56 is varied.

(e) The degree of static superheat is 3.155 K as 1.800 $Kg/cm^2G$ is selected for temperature 0° C.

In conventional thermostatic expansion valves, the degree of static superheat tends to increase in a low evaporating temperature range when the refrigerant sealed in the thermal bulb is the same as that used for the refrigerating system. This tendency of conventional thermostatic expansion valves is similar to the curves for $D_1=2$ mm in FIGS. 4A through 4C.

When the condensing temperature is high, PH is high so that the flow rate of the refrigerant passing through the central bore 56a of the valve seat 56 is high. When diameter $D_1$ of the central bore 56a is greater than 5 mm in this embodiment, the flow rate increases as the evaporating temperature goes down if the degree of superheat is constant.

When the diameter $D_1$ is smaller than 4 mm, the flow rate of refrigerant passing through the central bore 56a of the valve seat 56 tends to be reduced as the evaporating temperature goes down. For a thermostatic expansion valve according to the invention, the diameter $D_1$ may be appropriately selected depending on the conditions under which it is applied and the expected flow rate of refrigerant through the valve seat 56 under those conditions. For instance, the diameter $D_1$ greater than 4 mm should be selected if the central bore 56a should be opened at the degree of superheat 3.5 K under the condition of condensing temperature 30° C. and evaporating temperature −20° C.

It should be noted that the values plotted on FIGS. 4A through 4C are those calculated for certain given conditions and that in actual thermostatic expansion valve, the flow rate of the refrigerant is apt to be more affected by the condensing temperature as the valve diameter $D_1$ becomes large.

In other words, it is anticipated from the following equation which is derived from equation (3) that $$L=\frac{\psi(\delta,\Delta P)+\pi/4(D_1^2-D_2^2)(PH-PL)-Fo}{Ks+\pi C_1D_1\sin(2\theta_2)(PH-PL)} \quad (4)$$

where the diameter is $D_1$, PH is related to the condensing temperature, and $\Delta P$ in $\psi(\delta,\Delta P)$ represents the changes in the degree of superheat. These parameters are related to the distance L over which the valve body 70 is axially moved to open the valve seat 56 from its closure position. Thus, any increase of the value of each of $D_1$, PH and $\Delta P$ contributes to an increase in the value of L. Therefore, if the condensing temperature is raised, the rate of variation of the degree of superheat becomes too great and consequently the operating efficiency of the refrigerating system tends to be lowered.

Such a tendency can be effectively suppressed by augmenting the value of the second term of the denominator of equation (4). The second term of the denominator in equation (4) is produced by providing the taper angle on the valve body 70, and it may be obvious that the increasing rate, with which the flow rate of refrigerant passing through the central bore 56a of the valve seat 56 is increased and therefore the increasing rate with which the degree of superheat is increased, can be suppressed by augmenting the value of the second term even if the condensing temperature goes up. Thus, the term $$-4C_1LD_1\sin(2\cdot\theta_2)(PH-PL)$$

in equation (3) shows the amount of the reduction of the thrust load preliminarily applied to the valve body 70 in the direction toward the closure position due to the action of the refrigerant passing through the refrigerant pathway 54 and also preliminarily exerted on the valve body 70 so as to move the valve body 70 in the direction toward the open position. The amount of reduction as described above becomes maximum when the value $\theta_2$ of a half of the taper angle of the valve-seat abutting portion 70a is equal to 45°. Therefore, a value which is close to 45° is recommended for $\theta_2$ when the effect of suppressing the increasing rate of increase of the flow rate of refrigerant should be more conspicuous as the condensing temperature goes up.

Figure 5A:
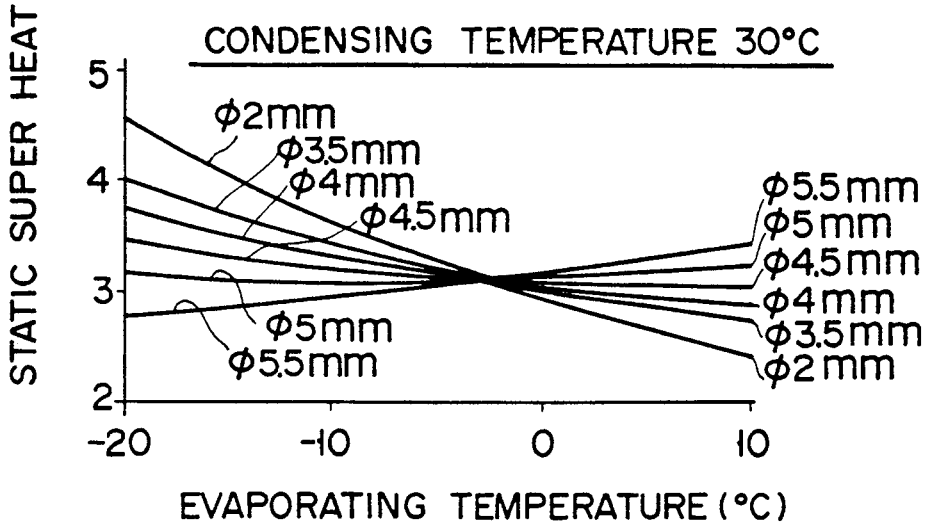
FIGS. 5A through 5C are graphs showing the relationship between the evaporating temperature of the refrigerant in the evaporator and the degree of superheat for different diameters of the central bore of the valve seat in a refrigerating system using the first embodiment when the degree of the valve opening is constantly 0.01 mm and the condensing temperatures are 50° C., 40° C. and 30° C.; in these graphs, it should be noted that these values of the degree of superheat under the above described condition are defined as the degrees of static superheat for this embodiment, and that the force of the flowing refrigerant exerted on the force transmitting member at the upstream side of the valve seat in the refrigerant pathway of the valve housing is disregarded.
Figure 5B:
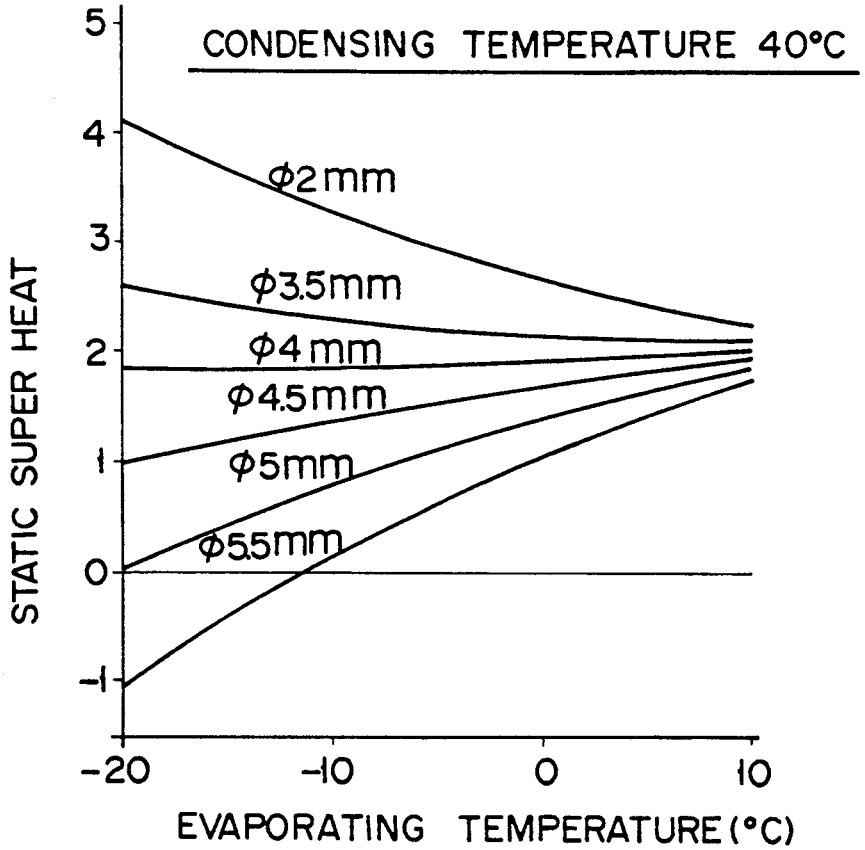
Figure 5C:
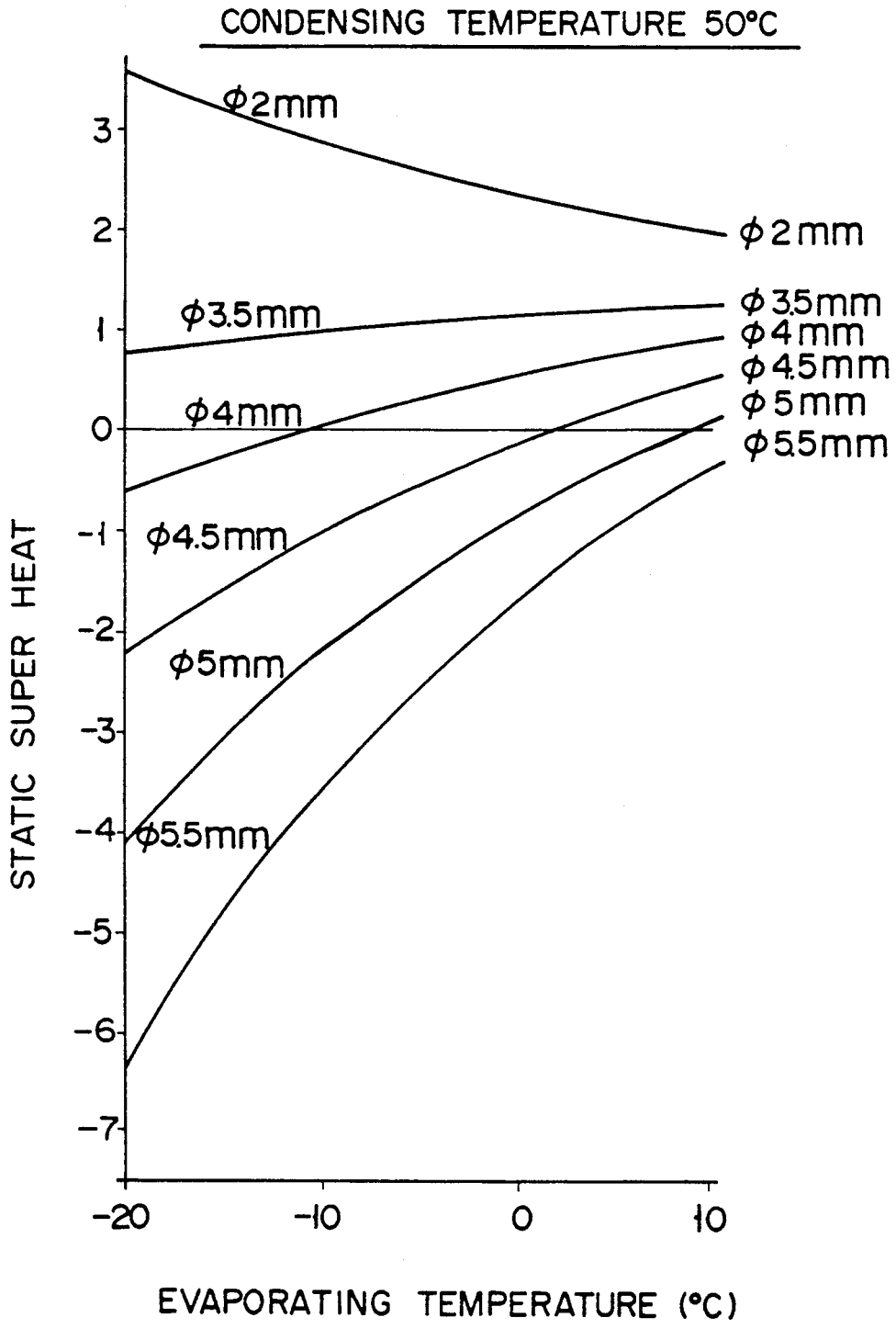

FIGS. 5A through 5C show how the degree of superheat varies depending on diameter $D_1$ of the central bore 56a of the valve seat 56 (valve diameter) and the evaporating temperature when the valve opening is set at 0.01 mm (near the valve closing position) and also when the condensing temperature is respectively set at 30° C., 40° C. and 50° C. It is seen from FIGS. 5A through 5C that the degree of static superheat varies remarkably according to the evaporating temperature when the condensing temperature is high and the valve diameter $D_1$ is too large.

Figure 6:
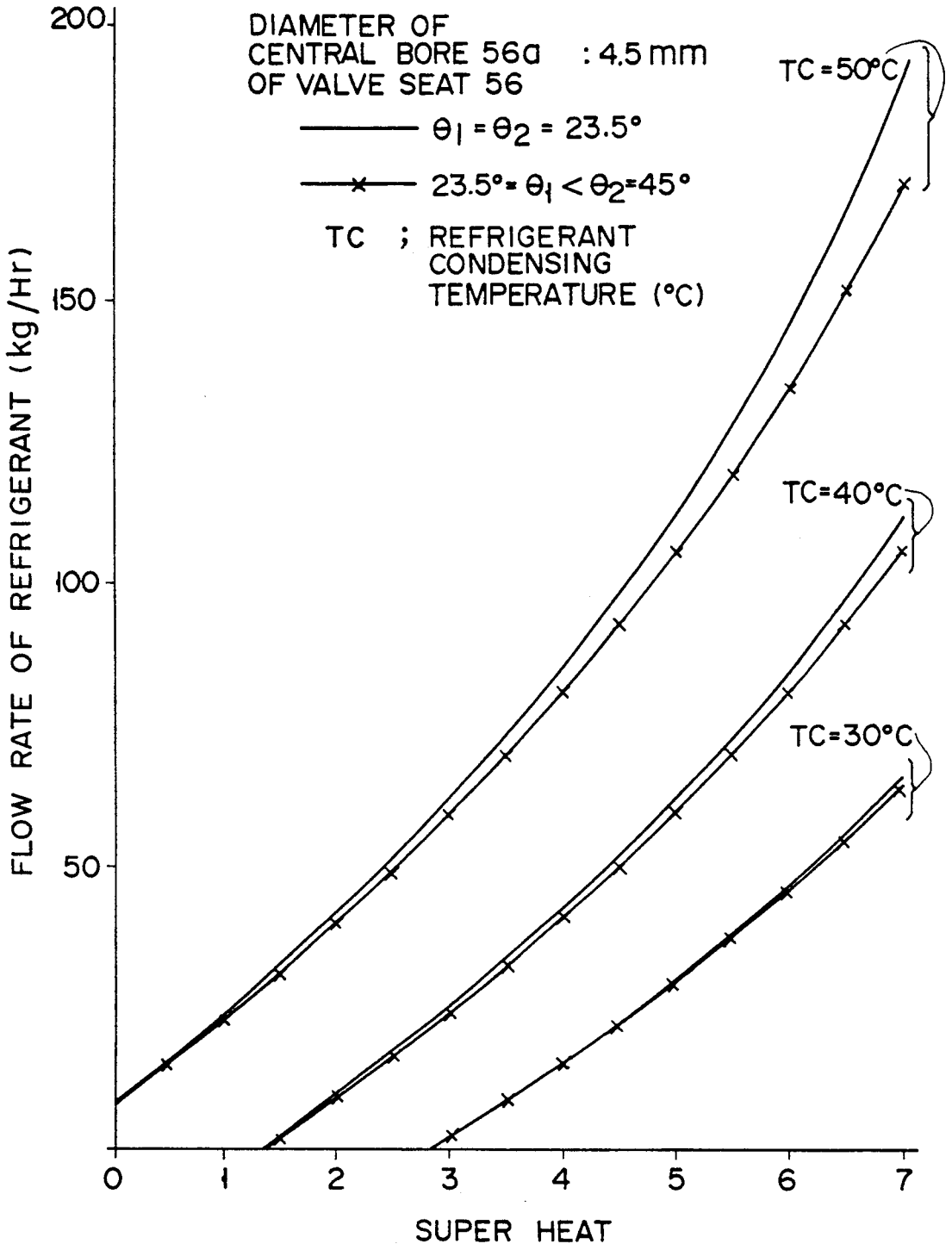
FIG. 6 is a graph showing how the augmenting tendency of the rate of variation in the degree of static superheat, corresponding to the variation in the evaporating temperature, for a high condensing temperature range can be suppressed by setting a value of the taper angle of the valve-seat abutting portion of the valve body larger than the taper angle of the valve-body biasing pressure portion; in this graph, it should be also noted that the force of the flowing refrigerant exerted on the force transmitting member at the upstream side of the valve seat in the refrigerant pathway of the valve housing is disregarded.

As described above, any excessive variation of the degree of staiic superheat can be suppressed by augmenting the value of the second term of the denominator of equation (4). FIG. 6 graphically show the effect of such suppression. It may be seen that, when $\theta_1<\theta_2=45°$ is assumed so as to increase the value of the second term, the suppression effect becomes more remarkable as the condensing temperature rises.

Whereas diameter $D_2$ of the force transmitting member 68 is assumed to be 0 in the foregoing description, in reality the force transmitting member 68 is subjected to a force of the flow of refrigerant at the upstream side of the valve seat 56 in the refrigerant pathway 54 of the valve housing 52.

A concrete value of $D_2$, that can attain the same advantages as that attained in a case of $D_2=0$, may be obtained by the following equation:

$$D_2 = \sqrt{Da^2 - Di^2}$$

where:

Di represents the value of Di when $D_2=0$ is assumed; and

Da represents the value of the valve diameter $D_1$ for the valve seat 56 used in combination with the force transmitting member 68 having the value of $D_2$ obtained by the above equation.

Figure 7A:
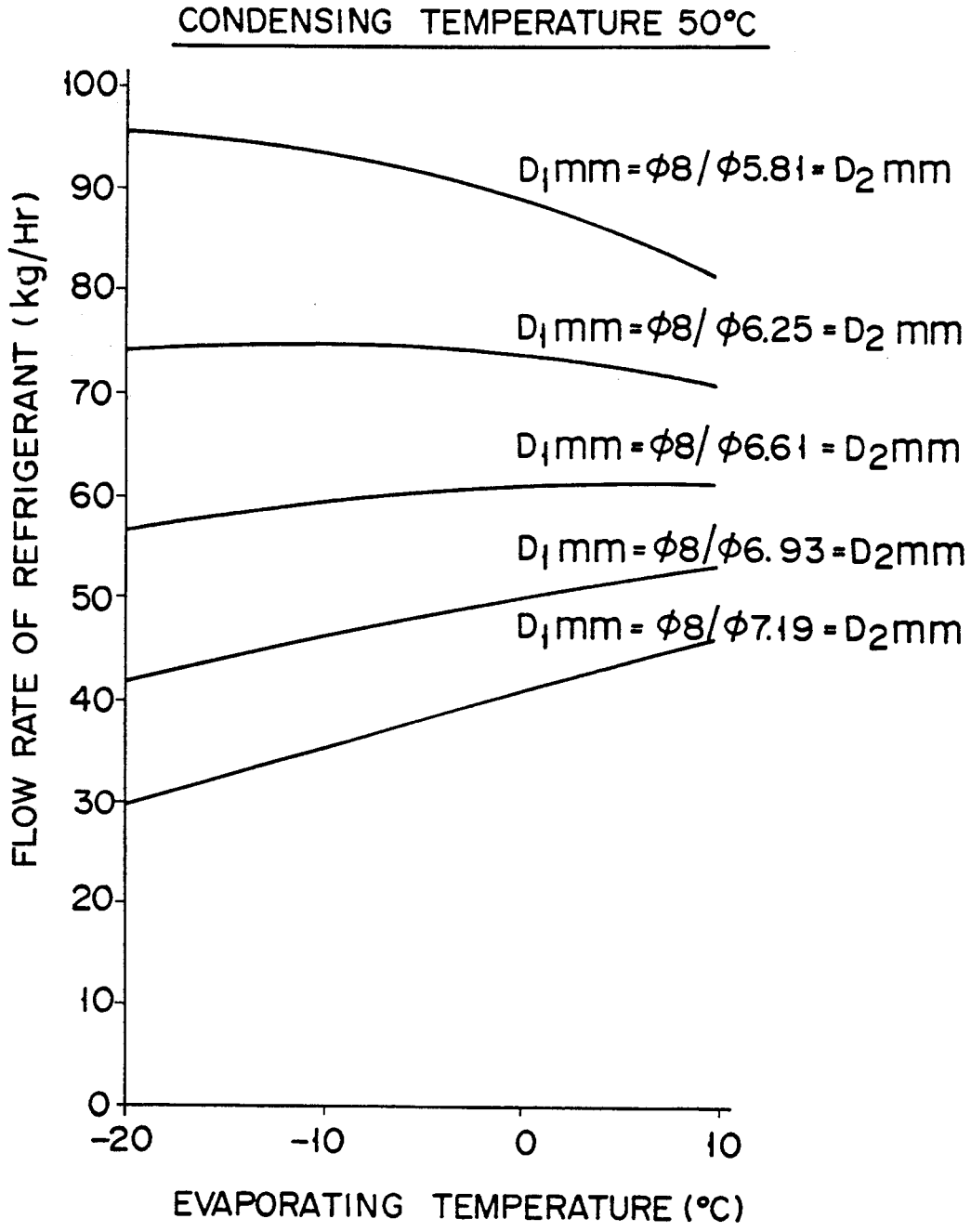
FIGS. 7A through 7C are graphs showing the relationship between the evaporating temperature of the refrigerant in the evaporator and the flow rate of refrigerant passing through the central bore of the valve seat, obtained by plotting the values calculated under an assumption that the degree of superheat is 3.5 K for different diameters of the force transmitting member in a refrigerating system using the first embodiment when the diameter of the central bore of the valve seat is constantly 8 mm and the condensing temperatures are respectively 50° C., 40° C. and 30° C.; in these graphs, it should be also noted that the force of the flowing refrigerant exerted on the force transmitting member at the upstream side of the valve seat in the refrigerant pathway of the valve housing is disregarded.
Figure 7B:
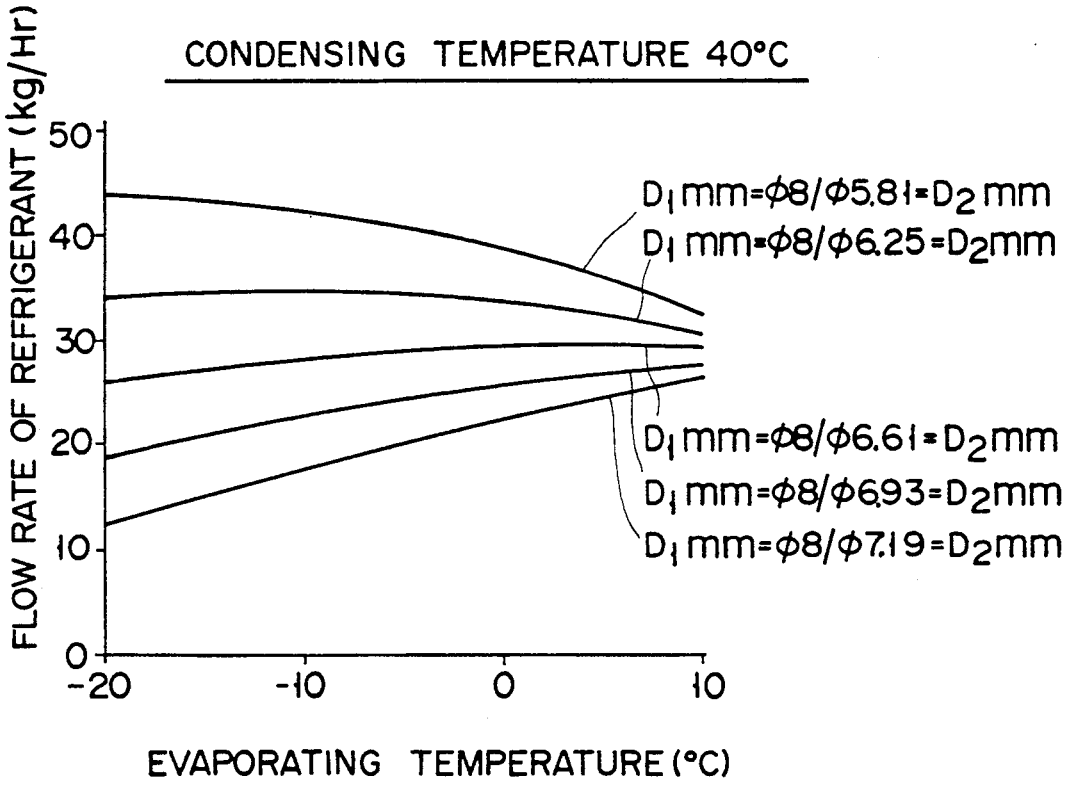
Figure 7C:
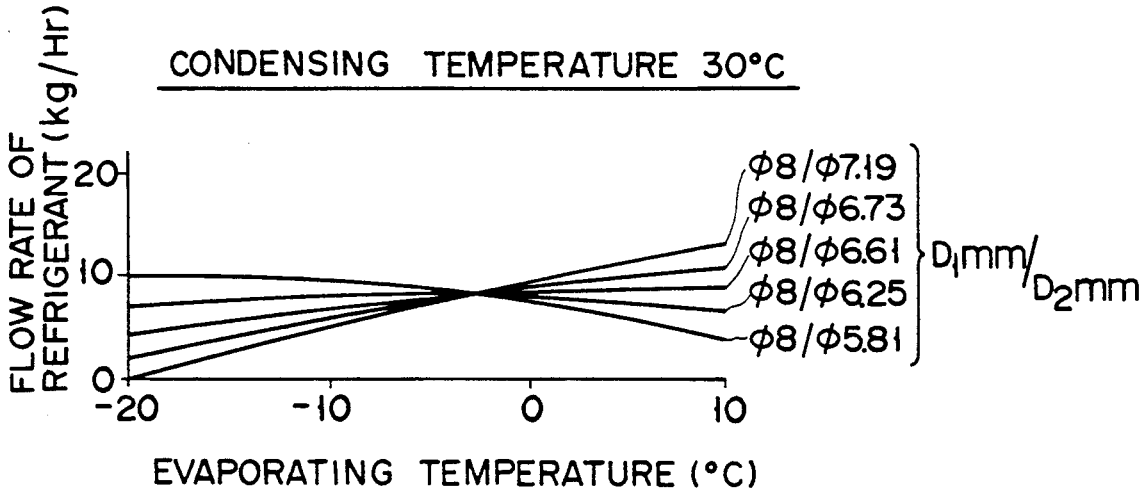

FIGS. 7A through 7C show how the theoretically calculated value of the flow rate of refrigerant passing through the central bore 56a of the valve seat 56 when the degree of the superheat is 3.5 K varies depending on the diameter $D_2$ of the force transmitting member 68 and the evaporating temperature when the valve diameter $D_1$ is set to 8 mm and the condensing temperature is respectively set at 50° C., 40° C. and 30° C.

Figure 8A:
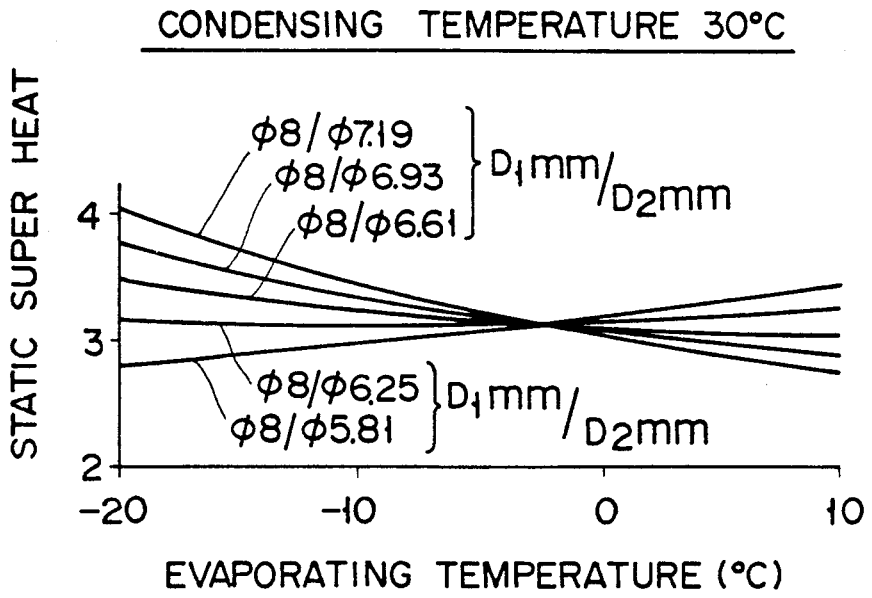
FIGS. 8A through 8C are graphs showing the relationship between the evaporating temperature of the refrigerant in the evaporator and the degree of static superheat under the conditions which are identical with those for FIGS. 7A through 7C when the degree of the valve opening is constantly 0.01 mm; here again, it should be noted that the force of the flowing refrigerant exerted on the force transmitting member at the upstream side of the valve seat in the refrigerant pathway of the valve housing is disregarded.
Figure 8B:
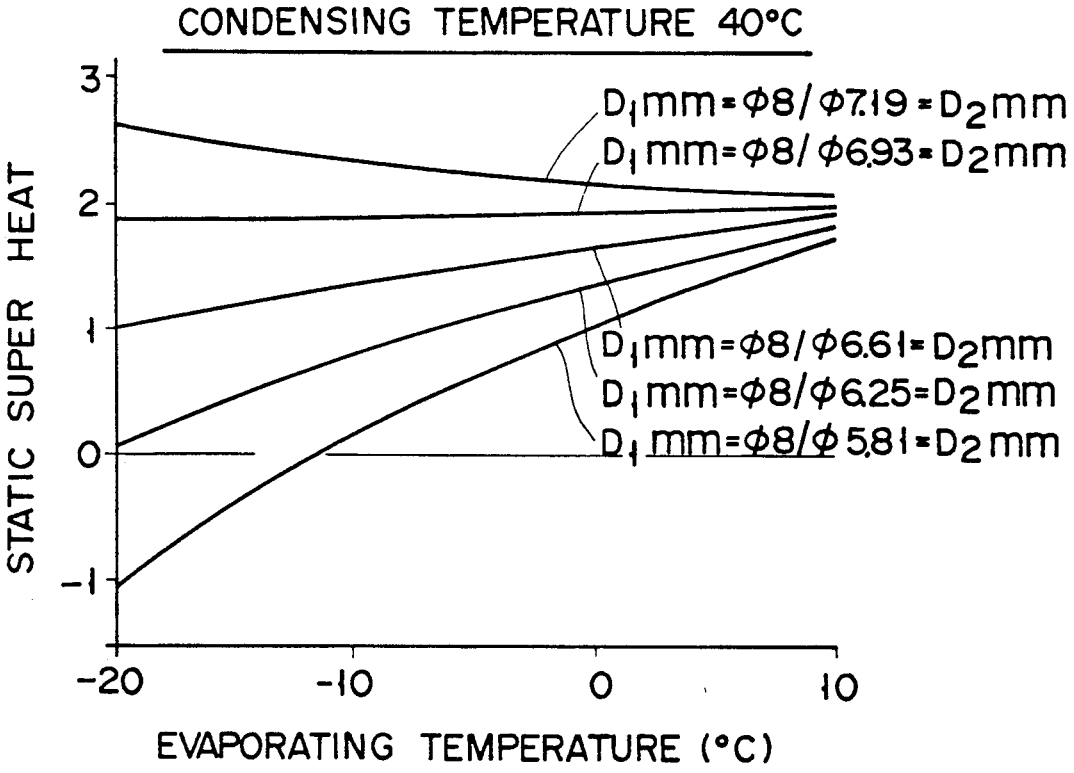
Figure 8C:
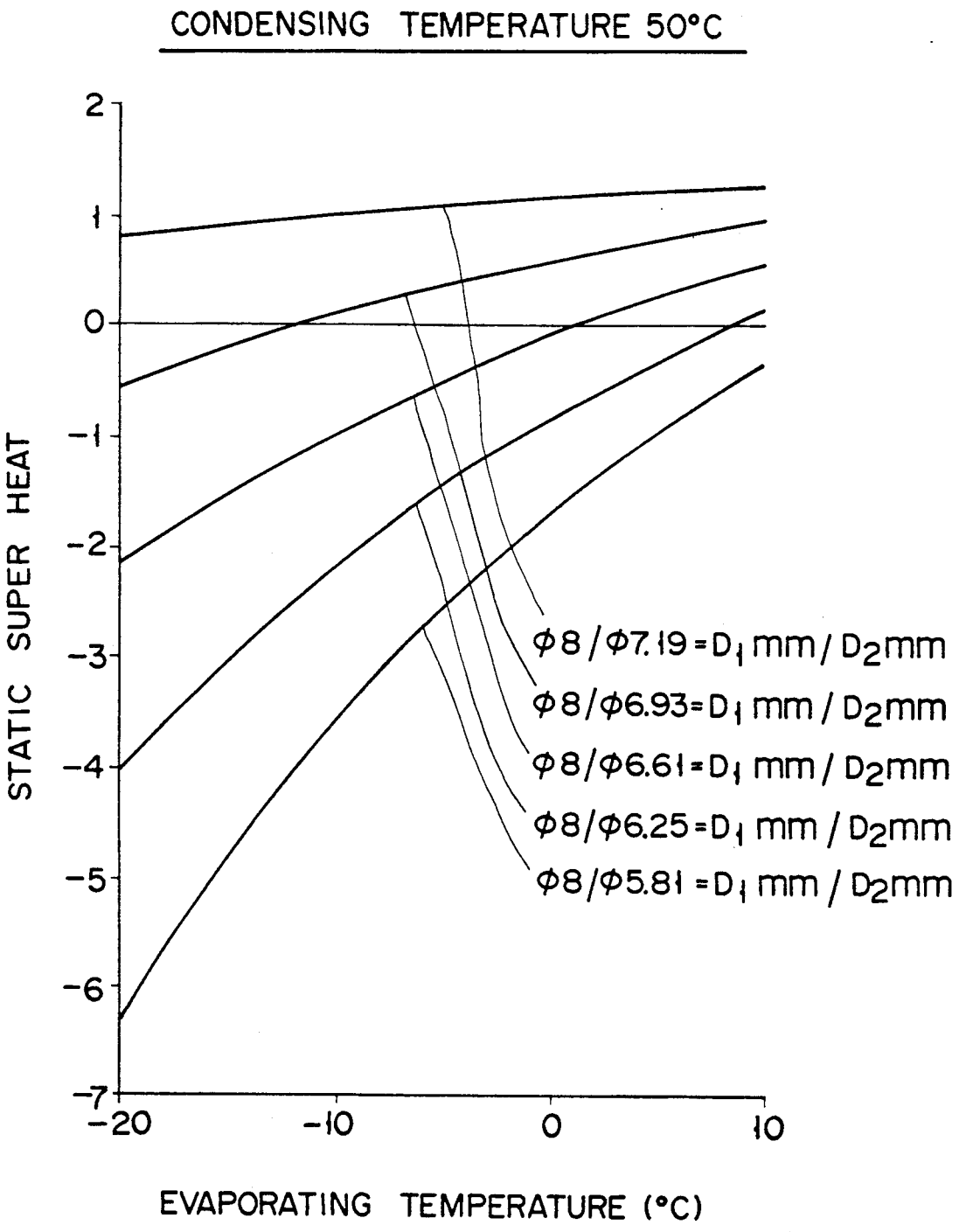

FIGS. 8A through 8C illustrate the relationship between the degree of superheat (the degree of static superheat; see the above described explanation relating to FIGS. 5A through 5C) and the evaporating temperature when the valve opening is 0.01 mm under the condition which is the same as that in the case of FIGS. 7A through 7C. It is seen that the graphical features of FIGS. 5A through 5C, where $D_2=0$ is assumed, are well reflected in FIGS. 8A through 8C and that the technological adequateness of the present invention is unaffected even, when the force transmitting member 68 of an actual thermostatic expansion valve is subjected to a force of the flow of refrigerant at the upstream side of the valve seat 56 in the refrigerant pathway 54. When the condensing temperature rises and the value of $\partial Q/\partial \Delta P$ becomes great, the flow rate of the refrigerant increases although the degree of superheat is kept constant. Such an undesirable increase in the flow rate can be suppressed by establishing the relationship $\theta_2>\theta_1$.

Figure 9:
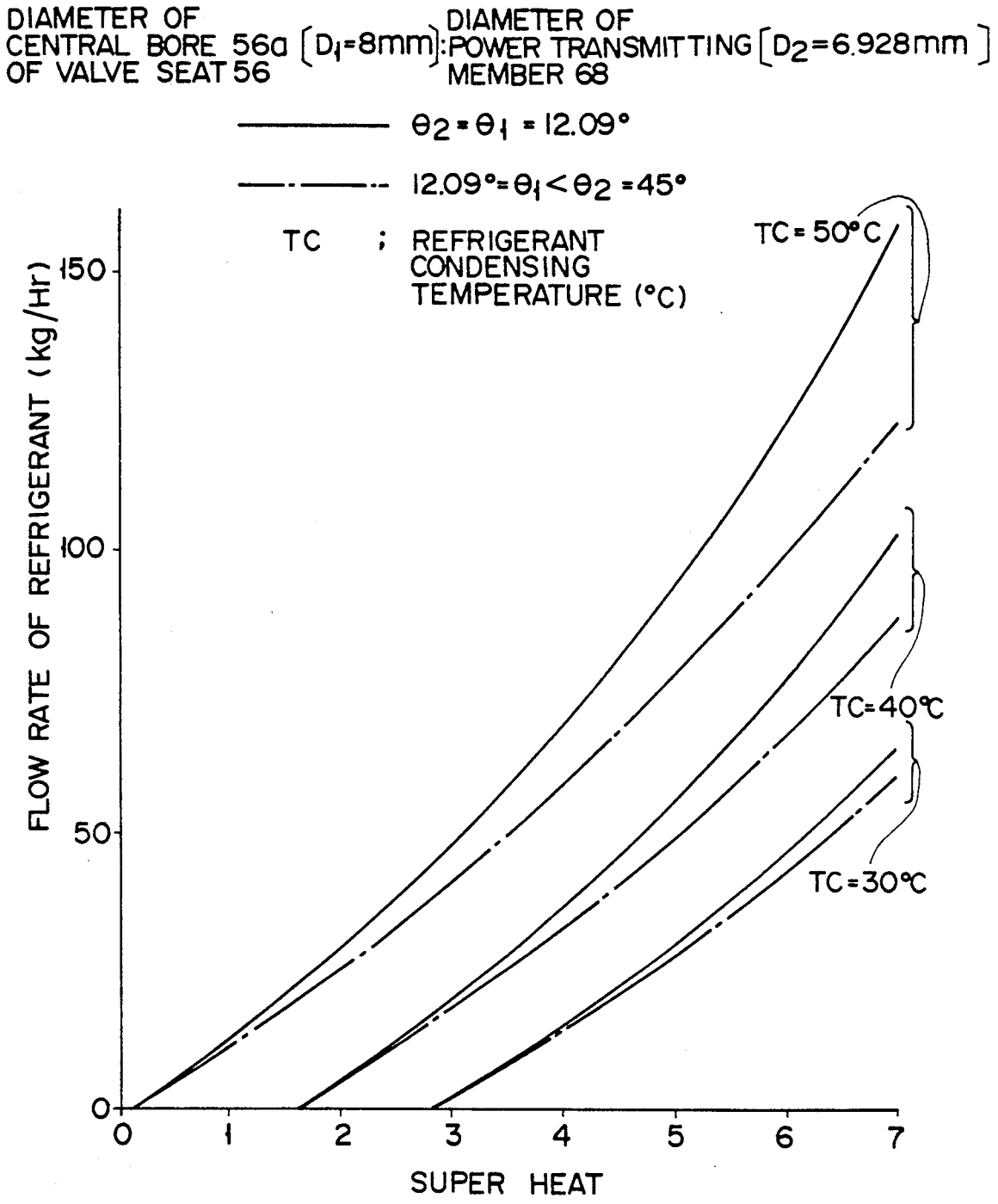
FIG. 9 is a graph showing how the augmenting tendency of the rate of variation in the degree of static superheat, corresponding to the variation in the evaporating temperature, for a high condensing temperature range can be suppressed by setting a value of the taper angle of the valve-seat abutting portion of the valve body larger than the taper angle of the valve-body biasing pressure portion; in this graph, it should be noted that the force of the flowing refrigerant exerted on the force transmitting member at the upstream side of the valve seat in the refrigerant pathway of the valve housing is taken into consideration.

FIG. 9 shows that the value of $\partial Q/\partial \Delta P$ can be reduced by establishing the relationship $\theta_2>\theta_1$ in the case of FIGS. 8A through 8C as well as in the case of FIGS. 5A through 5C.

Figure 10:
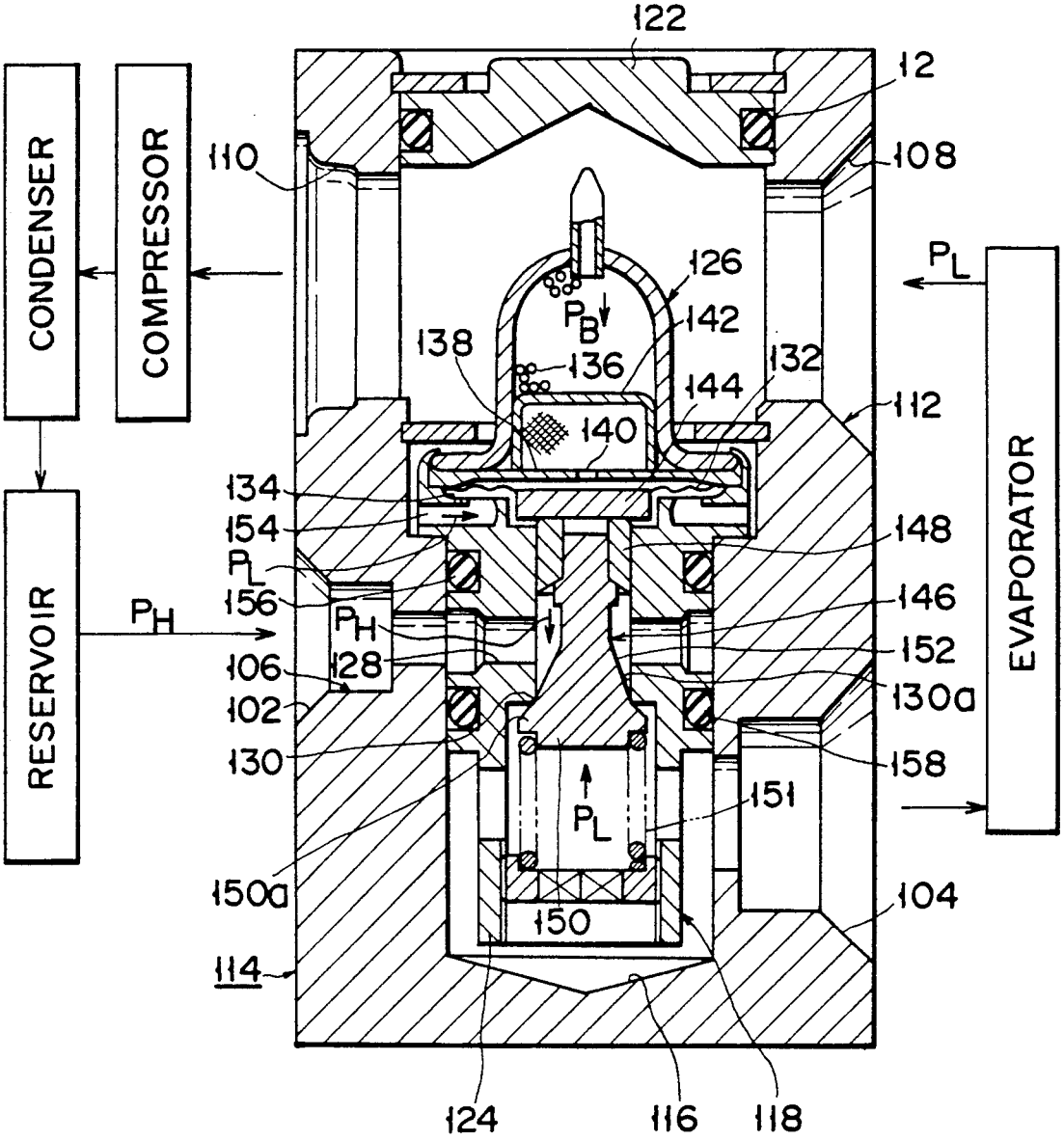
FIG. 10 is a longitudinal sectional view schematically showing a block-type thermostatic expansion valve according to a second embodiment of the present invention that is used in place of the conventional special expansion valve shown in FIG. 2.

Now referring to FIG. 10, a box type thermostatic expansion valve according to a second embodiment of the invention will be described.

The box type thermostatic expansion valve includes an aluminum joint block 114. In the joint block 114, a refrigerant inflow pathway 106, having a pressurized liquid refrigerant inlet 102 which is communicated with the outlet of the condenser and a refrigerant outlet 104 which is communicated with the inlet of the evaporator, and a refrigerant outflow pathway 112, having a vaporized refrigerant inlet 108 which is communicated with the outlet of the evaporator and a vaporized refrigerant outlet 110 which is communicated with the inlet of the compressor, are formed. A blind hole 116 penetrating between the refrigerant inflow pathway 10 and the refrigerant outflow pathway 12 is also formed in the joint block 114. The blind hole 116 functions as a hole for housing a thermostatic expansion valve 118. The opening of the hole 116 is sealingly closed at its top by a lid 122 having an O-ring.

The thermostatic expansion valve 118 has a valve housing 124 arranged in the refrigerant inflow pathway 106, and a thermal bulb 126 integrally fixed to the valve housing 124 so as to be located adjacent thereto and arranged in the refrigerant outflow pathway 112.

In the valve housing 124, a refrigerant pathway 128 opens at two axially separated positions on the peripheral surface of the valve housing 124. One opening of the refrigerant pathway 128 which is located closer to the thermal bulb 126 is communicated with the pressurized liquid refrigerant inlet 102 of the refrigerant inflow pathway 106 while the other opening of the refrigerant pathway 128 which is away from the thermal bulb 126 is communicated with the pressurized liquid refrigerant outlet 104. A valve seat 130 is formed in the refrigerant pathway 128 so as to be coaxial with the valve housing 124. The valve seat 130 orients itself toward the refrigerant outlet 104.

At an end portion of the valve housing 124 which is located adjacent to the thermal bulb 126, a diaphragm chamber 134 housing a diaphragm 132 is formed. The diaphragm 132 is so arranged in the diaphragm chamber 134 that it is perpendicular to and coaxial with the longitudinal center line of the valve housing 124. In this embodiment, the diaphragm 132 is made of a beryllium copper alloy, has a thickness of 0.1 mm, and has an outer diameter of 22 mm. A number of concentric waves are formed on the outer peripheral portion of the diaphragm 132 in order to generate a desired deflection thereof.

A certain amount of active carbon 136 and actuating fluid R-13 is contained in the thermal bulb 126 which is fixed to an end of the valve housing 124 so as to be located adjacent to the diaphragm chamber 134.

A partition wall 138 having a gas hole 140 formed at its center is arranged, between the diaphragm chamber 134 and the thermal bulb 126 in the valve housing 124. The gas hole 140 is covered with a metal net 142 in order to prevent the active carbon 136 in the thermal bulb 126 from flowing out into the diaphragm chamber 134 through the gas hole 140, The actuating fluid, contained in the thermal bulb 126 and having a pressure-temperature adsorbing characteristic based on the pressure in the bulb 126, takes a predetermined value depending on the temperature of the vaporized refrigerant flowing through the refrigerant outflow pathway 112 of the joint block 114. That, is, the actuating fluid is adsorbed on or de-adsorbed from the active carbon 136 depending on that temperature. The actuating fluid applies its vapor pressure on the diaphragm 132 by way of the gas hole 140 in the partition wall 138.

The diaphragm 132 abuts a diaphragm-carrying member 144 which is arranged coaxially with the diaphragm 132 on the opposite side relative to the thermal bulb 126. The diaphragm-carrying member 144 is connected by way of a cylindrical collar 148 with the top end a of generally cylindrical force transmitting member 146 extended coaxially from the central bore 130*a* of the valve seat 130 along the longitudinal center line in the valve housing 124. The collar 148 prevents the pressurized liquid refrigerant from flowing into the diaphragm chamber 134 from the refrigerant pathway 128 in the valve housing 124.

A valve body 150 is integrally formed on the lower end of the force transmitting member 146 at the downstream side of the valve seat 130 in the refrigerant pathway 128. The valve body 150 has a circular truncated cone shape with its top being oriented toward the upstream side. Its peripheral surface forms a valve-seat abutting portion 150*a* that intimately abuts the valve seat 130.

The valve body 150 is biased to the closure position by a compressed coil spring 151 provided as a biasing means at the downstream side of the valve seat 130 in the refrigerant pathway 128 in order to tightly abut the valve-seat abutting portion 150*a* on the valve seat 130 of the valve housing 124.

At the lower end of the force transmitting member 146, a valve-body biasing pressure, portion 152 is formed adjacent to the valve body 150 at the upstream side of the valve body 150. The valve-body biasing pressure portion 152 is located in the central bore 130*a* of the valve seat 130, and has a circular truncated cone shape with its top being oriented toward the upstream side just like the valve-seat abutting portion 150*a*.

The diaphragm chamber 134 in the valve housing 124 is communicated with the refrigerant outflow pathway 112 in the joint block 114 by way of a pressure balancing hole 154 formed in the valve housing 124. The pressure balancing hole 154 applies the pressure of the vaporized refrigerant at the outlet of the evaporator in the refrigerant outflow pathway 112 onto the lower surface of the diaphragm 132.

In the above described embodiment, any excessive deflection of the diaphragm 132 is effectively prevented by the partition wall 134 which serves as the upper wall of the diaphragm chamber 134 and the diaphragm-carrying member 144.

In this embodiment, a first seal 156 is provided between the diaphragm chamber 134 and the pressurized liquid refrigerant inlet 102 on the outer peripheral surface of the valve housing 124 in order to prevent the pressurized liquid refrigerant from leaking into the refrigerant outflow pathway 112 from the refrigerant inflow pathway 106 of the joint block 114 through the gap between the inner peripheral surface of the blind hole 116 and the outer peripheral surface of the valve housing 124.

Between the pressurized liquid refrigerant inlet 102 and the refrigerant outlet 104 on the outer peripheral surface of the valve housing 124, there is provided a second seal 158 in order to prevent the highly pressurized liquid refrigerant from leaking into the refrigerant outlet 104 from the pressurized liquid refrigerant inlet 102 of the refrigerant inflow pathway 106 in the joint block 114 through the gap between the inner peripheral surface of the blind hole 116 and the outer peripheral surface of the valve housing 124.

In the box type thermostatic expansion valve according to the second embodiment of the invention and constructed as described above, the movement of the valve body 150 between the open position and the closure position is determined in the exactly same manner as the first embodiment described earlier. More specifically, the movement of the valve body 150 is determined by a balance between the following three forces. The first one of the three forces is $F_1$ which is applied on the valve body 150 by the diaphragm 132 by way of the diaphragm-carrying member 144, the collar 148, and the force transmitting member 146. The force F1 is defined by a differential pressure $\Delta P$, which is the difference between gas pressure $P_B$ of the actuating fluid in the thermal bulb 126 to be applied on the upper surface of the diaphragm 132 and vapor pressure $P_L$ of the vaporized refrigerant at the outlet of the evaporator to be applied on the lower surface of the diaphragm 132 through the pressure balancing hole 154, and the deflection $\delta$ of the diaphragm 132 due to the differential pressure $\Delta P$. The second one of the three forces is a force of the compression coil spring 151 with which the valve body 150 is biased. The third one of the three forces is a pressure of the pressurizing liquid refrigerant to be applied on the valve-body biasing pressure portion 152 of the force transmitting member 146 at the upstream side of the valve seat 130 in the refrigerant pathway 128 of the valve housing 124.

Figure 11:
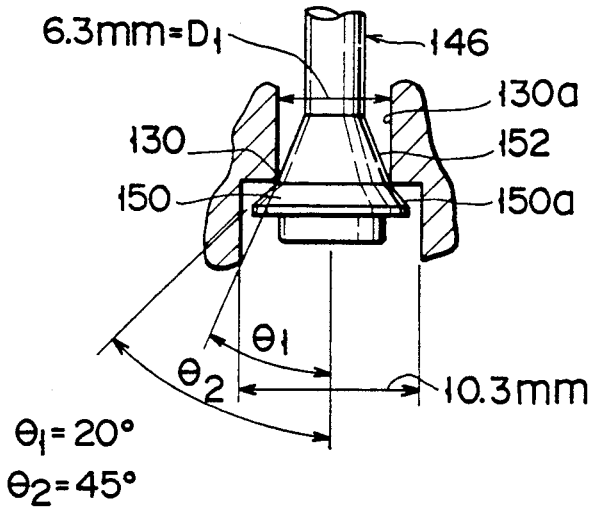
FIG. 11 is a longitudinal sectional view schematically showing on an enlarged scale a valve body, a valve-body biasing pressure means of the force transmitting member, and a valve seat to be used, in combination with them, in the block-type thermostatic expansion valve of the second embodiment of FIG. 2.

FIG. 11 shows the main dimensions of the valve body 150, those of the valve-body biasing pressure portion 152 of the force transmitting member 146, and those of the central bore 130*a* of the valve seat 130, which have relationships to the dimensions of the two former components.

Figure 12:
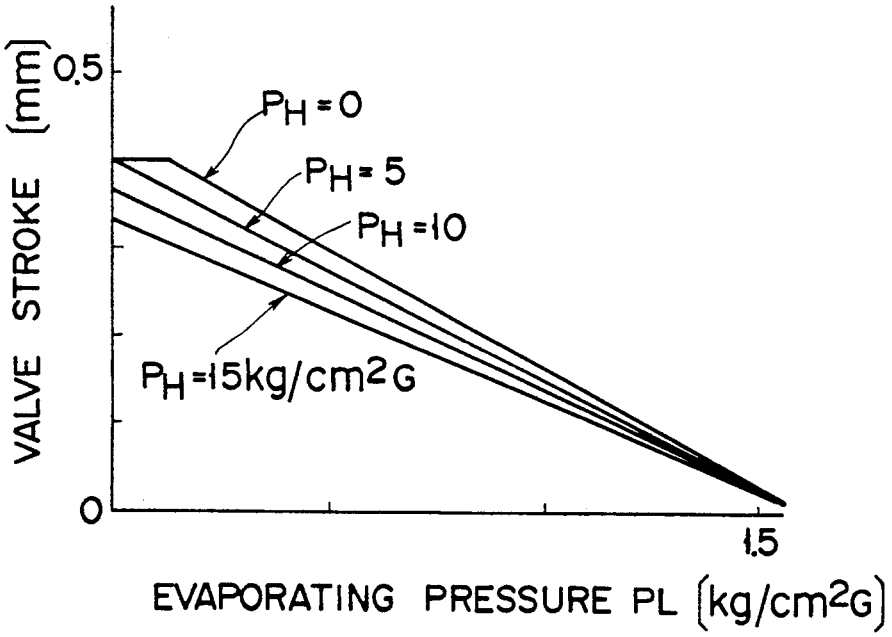
FIG. 12 is a graph schematically showing the relationship between the evaporating pressure and the degree of the valve opening when the condensing pressure changes in the block-type thermostatic expansion valve of the second embodiment of FIG. 2.

FIG. 12 shows the relationship between the vapor pressure PL and the valve stroke for various condensing pressures $P_H$. It may be seen from FIG. 12 that, when condensing pressure $P_H$ is high, the gradient of the line showing the relationship between the vapor pressure $P_L$ and the valve stroke is low so that any augmentation in the rate of temperature rise in the system due to the raised condensing temperature can be effectively restricted. This phenomenon significantly contributes to the operating stability of the refrigerating system and improve its operating efficiency. The above effects are realized by setting a value $\theta_2$ of a half of the taper angle of the valve-seat abutting portion 150*a* of the valve body 150 smaller than the value $\theta_1$ of a half of the taper angle of the valve-body biasing pressure portion 152. They can be maximized when $\theta_2$ is set to be approximately equal to 45°.

Figure 13:
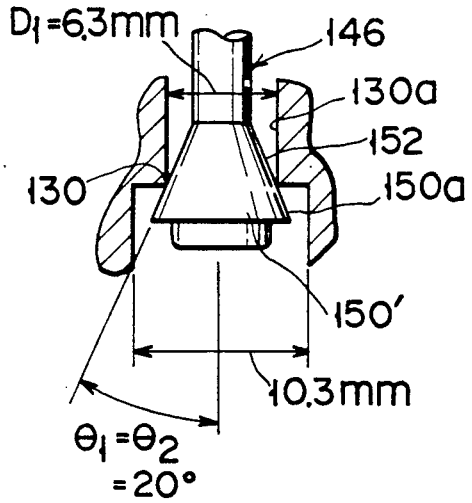
FIG. 13 is a longitudinal sectional view schematically showing on an enlarged scale a valve body, used in place of the valve body shown in FIG. 12, in the block-type thermostatic expansion valve of the second embodiment of FIG. 10 in order to prove technical advantages attained by the valve body shown in FIG. 12.
Figure 14:
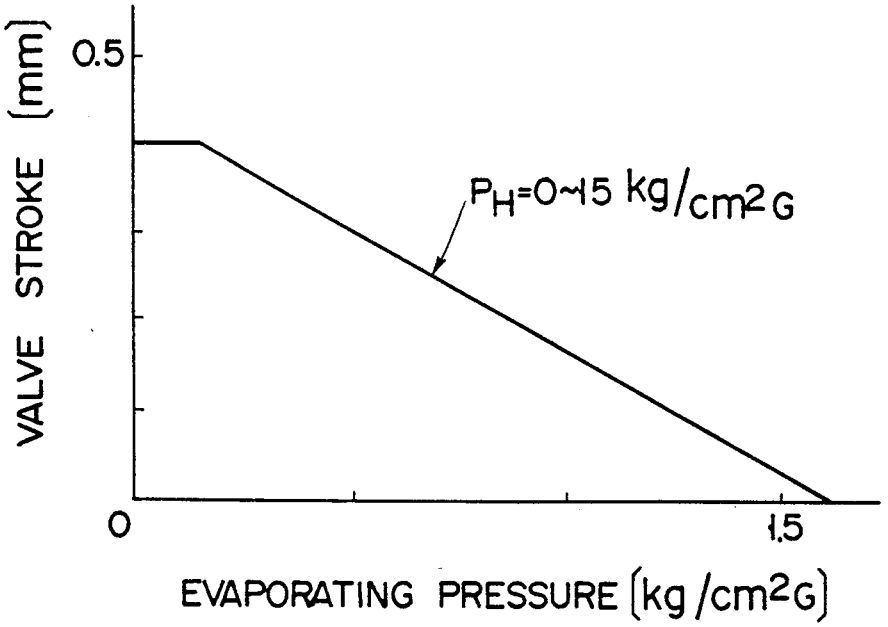
FIG. 14 is a graph showing the relationship between the evaporating pressure and the degree of the valve opening when the condensing pressure changes in the block-type thermostatic expansion valve of the second embodiment of FIG. 10 in which the valve body of FIG. 13 is used in place of the valve body of FIG. 12.

In order to prove the above described effects, an experiment was conducted by replacing the valve body 150, having a valve-seat abutting portion 150*a* with a value $\theta_2$ of a half of the taper angle equal to a value $\theta_1$ of a half of the taper angle of the valve-body biasing pressure, portion 152, as illustrated in FIG. 13, with the valve body 150. FIG. 14 shows the relationship between evaporating pressure and the valve stroke for a various condensing pressure $P_H$, obtained in this experiment. As seen from FIG. 14, the gradient of the line for the various condensing pressure $P_H$ will not change, meaning that a rise of condensing temperature will not augment the rising rate of the degree of the superheat and consequently will not make the refrigerating system unstable and inefficient.

What is claimed is:

1. A thermostatic expansion valve to be used in a refrigerating system having a compressor, a condenser, an evaporator, and an expansion means, and using a refrigerant for heat exchange comprising:

a valve housing having a refrigerant pathway in which a valve seat is formed and a diaphragm chamber in which a diaphragm is housed;

a valve body arranged in said valve housing so as to be movable between a closure position where it is in contact with said valve seat and an open position where it is separated from said valve seat, and connected with one side surface of said diaphragm so as to be movable between the closure position and the open position in accordance with a displacement of said diaphragm;

biasing means, provided in said valve housing, for biasing said valve body toward the closure position;

auxiliary pressure applying means for applying a pressure of the refrigerant, sensed at a downstream side of said valve seat, on the side surface of said diaphragm;

principal pressure applying means, having a thermal bulb which contains an actuator vapor and is located at an outlet of said evaporator, for applying a pressure of the actuator vapor in response to temperature at the outlet of said evaporator, on another side surface of said diaphragm; and valve-body biasing pressure means, provided on said valve body, for biasing said valve body from the closure position toward the open position by the pressure of the refrigerant sensed at an upstream side of said valve seat in the refrigerant pathway of said valve housing;

wherein a degree of valve opening is defined by a different between a first force applied on one side surface of said diaphragm and a second force applied on the other side surface thereof;

wherein the first force is a sum of the pressure of the refrigerant, sensed at the downstream side of said valve seat and applied on one side surface by said auxiliary pressure applying means, and a biasing force, applied on one side surface by said biasing means by said valve body;

wherein the second force is a sum of the pressure of the actuator vapor, contained in the thermal bulb and applied on the other side surface of said diaphragm by said principal pressure applying means and the pressure of the refrigerant, sensed at the upstream side of said valve seat in the refrigerant pathway of said valve housing and applied on the other side surface of said diaphragm by said valve-body biasing pressure means; and wherein a parameter for said first force and a parameter for said second force are so selected that the second force becomes higher than the first force so that the refrigerant can be supplied at a flow rate over a predetermined value to said evaporator even when a value of a degree of superheat is lower than a value of a degree of pre-set static superheat in a case where a difference in the pressure of the refrigerant on said valve body between the upstream side of said valve seat and the downstream side thereof is larger than a pressure difference which is used as a base for setting the degree of static superheat of said thermostatic expansion valve.

2. A thermostatic expansion valve according to claim 1, wherein a valve-seat abutting portion of said valve body is located at the downstream side of said valve body in the refrigerant pathway and has a circular truncated cone with a top means for orienting toward the upstream side of a flow of the refrigerant in said refrigerant pathway;

wherein said valve body is fitted on an end of a cylindrical force transmitting member whose other end abuts one side surface of said diaphragm;

wherein a diameter of said diaphragm and a diameter of a central bore of said valve seat is defined by the following formula:

$$\psi(\delta,\Delta P)+\pi/4(PH-PL)\{(D_1^2-D_2^2)-4C_1LD_1\sin 2\theta_2\}-(Fo+KsL)=0$$

where:

$\psi$ ($\delta$,$\Delta$P) is a force F1 with which said diaphragm pushes said valve body, that is the force $F_1=\psi(\delta,\Delta P)$ which is a function of a pressure value $\Delta$P that is converted from the degree of superheat and a deflection $\delta$ of said diaphragm;

PH is a saturated pressure of the refrigerant at a condensing temperature;

PL is a saturated pressure of the refrigerant at an evaporating temperature;

$D_1$ is the diameter of the central bore of said valve seat;

$D_2$ is a diameter of said force transmitting member having a circular cross section (i.e. $D_2 \rightarrow 0$ is assumed when said force transmitting member is not subjected to a force of a flow of refrigerant at the upstream side of said valve seat in the refrigerant pathway, and when $D_2 \rightarrow 0$ is assumed, a propulsive force to move said valve body from the closure position to the open position, generated by a difference between the pressure PH of the refrigerant sensed at the upstream side of said valve seat in the refrigerant pathway of said valve housing and the pressure PL of the refrigerant sensed at the downstream side of said valve seat in the refrigerant pathway of said valve housing, becomes maximum;

$C_1$ is a flow coefficient of the refrigerant in the refrigerant pathway in said valve housing;

L is a distance over which said valve body is axially moved from its closure position to its open position;

$\theta_2$ is a half of a taper angle of said valve-seat abutting portion of said valve body;

Fo is a preliminary load applied by said valve-body biasing means; and

Ks is a coefficient for determining a biasing force generated by said valve-body biasing means, said biasing force increasing as the distance L of displacement of said valve body becomes greater.

3. A thermal expansion valve according to claim 1, wherein a valve-seat abutting portion of said valve body is located at the downstream side of said valve seat in the refrigerant pathway of said valve housing, and has a first circular truncated cone with a top means for orienting toward the upstream side of a flow of refrigerant in the refrigerant pathway;

wherein said valve-body biasing pressure means has another circular truncated cone formed adjacent to and at the upstream side of said valve-seat abutting portion of said valve-body with the top means for orienting toward the upstream side; and wherein a taper angle of the other circular truncated cone of said valve-body biasing pressure means is so defined as to be smaller than a taper angle of the first circular truncated cone of the valve-seat abutting portion of said valve body.

4. A thermostatic expansion valve according to claim 3, wherein a half of the taper angle of the first circular truncated cone of said valve-seat abutting portion of said valve body is approximately equal to $\pi/4$.

5. A thermostatic expansion valve to be used in a refrigerating system having a compressor, a condenser, an evaporator, and an expansion means, and using a refrigerant for heat exchange comprising:

a valve housing having a refrigerant pathway in which a valve seat is formed and a diaphragm chamber in which a diaphragm is housed;

a valve body arranged in said valve housing so as to be movable between a closure position where it is in contact with said valve seat and an open position where it is separated from said valve seat, and connected with one side surface of said diaphragm so as to be movable between the closure position and the open position in accordance with a displacement of said diaphragm;

biasing means, provided in said valve housing, for biasing said valve body toward the closure position;

auxiliary pressure applying means for applying a pressure of the refrigerant sensed at a downstream side of said valve seat on the one side surface of said diaphragm;

a thermal bulb containing an actuator vapor and being arranged adjacent to and integrally with the diaphragm chamber so as to apply pressure of the actuator vapor to another side surface of said diaphragm;

valve-body biasing pressure means, mounted on said valve body, for biasing said valve body from the closure position toward the open position by pressure of the refrigerant at an upstream side of said valve seat in the refrigerant pathway of said valve housing; and a joint block having a refrigerant inflow pathway communicated with a refrigerant inlet of the evaporator and a refrigerant outflow pathway communicated with a refrigerant outlet of the evaporator, and containing said valve housing integrated with said thermal bulb, so that the refrigerant pathway of said valve housing is arranged in the refrigerant inflow pathway and said thermal bulb is arranged in the refrigerant outflow pathway;

wherein a degree of a valve opening is defined by a difference between a first force applied on one side surface of said diaphragm and a second force applied on the other side surface thereof;

wherein the first force is a sum of the pressure of the refrigerant, sensed at the downstream side of said valve seat and applied on one side surface by said auxiliary pressure applying means, and a biasing force, applied on one side surface by said biasing means by said valve body;

wherein second force is a sum of the pressure of the actuator vapor, contained in the thermal bulb and applied on the other side surface of said diaphragm by said principal pressure applying means, and the pressure of the refrigerant, sensed at the upstream side of said valve seat in the refrigerant pathway of said valve housing and applied on the other side surface of said diaphragm by said valve-body biasing pressure means; and wherein a parameter for said first force and a parameter for said second force are so selected that the second force becomes higher than the first force so that the refrigerant can be supplied at a flow rate over a predetermined value to said evaporator even when a value of a degree of superheat is lower than a value of a degrees of a pre-set static superheat in a case where a difference in the pressure of the refrigerant on said valve body between the upstream side of said valve seat and the downstream side thereof is larger than a pressure difference which is used as a base for setting the degree of the static superheat of said thermostatic expansion valve.

6. A thermostatic expansion valve according to claim 5, wherein a valve-seat abutting portion of said valve body is located at the downstream side of said valve body in the refrigerant pathway and has a circular truncated cone with a top means for orienting toward the upstream side of the flow of refrigerant in said refrigerant pathway;

wherein said valve body is fitted on an end of a cylindrical force transmitting member whose other end abuts one side surface of said diaphragm;

wherein a diameter of said diaphragm and a diameter of a central bore of said valve seat is defined by the following formula:

$$\psi(\delta, \Delta P) + \pi/4(PH - PL)\{(D_1^2 - D_2^2) - 4C_1LD_1 \sin 2\theta_2\} - (Fo - KsL) = 0$$

where:

$\psi(\delta,\Delta P)$ is a force F1 with which said diaphragm pushes said valve body, that is $F_1 = \psi(\delta,\Delta P)$ and F1 is a function of a pressure value $\Delta P$ which is converted from the degree of superheat and a deflection of $\delta$ of said diaphragm;

PH is a saturated pressure of the refrigerant at a condensing temperature;

PL is a saturated pressure of the refrigerant at an evaporating temperature;

$D_1$ is a diameter of the central bore of said valve seat;

$D_2$ is a diameter of said force transmitting member having a circular cross section (i.e. $D_2 \rightarrow 0$ is assumed when said force transmitting member is not subjected to a force of the flow of refrigerant at the upstream side of said valve seat in the refrigerant pathway and when $D_2 \rightarrow 0$ is assumed, a propulsive force to move said valve body from the closure position to the open position, generated by a difference between the pressure PH of the refrigerant sensed at the upstream side of said valve seat in the refrigerant pathway of said valve housing and the pressure PL of the refrigerant sensed at the downstream side of said valve seat in the refrigerant pathway of said valve housing, becomes maximum;

$C_1$ is a flow coefficient of the refrigerant in the refrigerant pathway in said valve housing;

L is a distance over which said valve body is axially moved from its closure position to its open position;

$\theta_2$ is a half of a taper angle of said valve-seat abutting portion of said valve body;

Fo is a preliminary load applied by said valve-body biasing means; and

Ks is a coefficient for determining a biasing force generated by said valve-body biasing means, said biasing force increasing as the distance L of displacement of said valve body becomes greater.

7. A thermostatic expansion valve according to claim 5, wherein a valve-seat abutting portion of said valve body is located at the downstream side of said valve seat in the refrigerant pathway of said valve housing, and has a circular truncated cone with a top means for orienting toward the upstream side of the flow of refrigerant in the refrigerant pathway;

said valve-body biasing pressure means has another circular truncated cone formed adjacent to and at the upstream side of said valve-seat abutting portion of said valve body with the top means for orienting toward the upstream side; and wherein a taper angle of the other circular truncated cone of said valve-body biasing pressure means is so defined as to be smaller than a taper angle of the first circular truncated cone of the valve-seat abutting portion of said valve body.

8. A thermostatic expansion valve according to claim 7, wherein a half of the taper angle of the first circular truncated cone of said valve-seat abutting portion of said valve body is approximately equal to $\pi/4$.

* * * * *

UNITED STATES PATENT AND TRADEMARK OFFICE

CERTIFICATE OF CORRECTION

PATENT NO. : 5,005,370

DATED : April 9, 1991

INVENTOR(S) : H. Tanaka et al.

It is certified that error appears in the above-identified patent and that said Letters Patent is hereby corrected as shown below:

Cover page, left col., section [54], line 1, change "THERMAL" to --THERMOSTATIC--; and section [56], line 5, change "62/210X" to --62/211X--.

Col. 1, line 2, change "THERMAL" to --THERMOSTATIC--.

Col. 2, line 42, delete "the"; and line 58, change "is" (second occurrence) to --in--.

Col. 3, line 31, change "abutts" to --abuts--, change "the" (second occurrence) to --said--, and change "is" to --being--.

Col. 4, line 15, after "to", insert --a--;

line 21, delete ","; and line 24, delete "of".

Col. 5, line 9, change "valve-body" to --valve body--;

line 13, change "thermal" to --thermostatic--;

line 49, change "valve" to --valves--;

line 55, delete ","; and line 57, change "big" to --large--.

UNITED STATES PATENT AND TRADEMARK OFFICE

CERTIFICATE OF CORRECTION

PATENT NO. : 5,005,370

DATED : April 9, 1991

INVENTOR(S) : H. Tanaka et al.

It is certified that error appears in the above-identified patent and that said Letters Patent is hereby corrected as shown below:

Col. 6, line 9, change "has" to --have--; and line 64, after "and", insert --that the valve body--.

Col. 7, line 13, after "pressure", insert --means--.

Col. 9, line 38, change "a" (second occurrence) to --the--; and line 59, after "diaphragm" but before the period, insert --58--.

Col. 10, line 19, after "arranged", insert --at the--; and line 34, change "valve seat" to --valve-seat--.

Col. 12, line 26, change "valve" to --valves--; and line 40, change "open" to --lift--.

Col. 13, line 22, change "show" to --shows--; and line 66, delete ",".

Col. 14, line 26, change "10" to --106--;

line 27, change "12" to --112--;

line 34, after "and", insert --also has--; and line 68, delete ",".

UNITED STATES PATENT AND TRADEMARK OFFICE

CERTIFICATE OF CORRECTION

PATENT NO. : 5,005,370

DATED : April 9, 1991

INVENTOR(S) : H. Tanaka et al.

It is certified that error appears in the above-identified patent and that said Letters Patent is hereby corrected as shown below:

Col. 15, line 5, change "," (first occurrence) to --.--;

line 11, delete "," (first occurrence);

line 21, change "a of" to --of a--;

line 43, delete "," (second occurrence); and line 60, delete "134".

Col. 16, line 15, change "box type" to --box-type--; and line 50, change "PL" to --$P_L$--.

Col. 17, line 3, delete "," (first occurrence);

line 4, change "150" to --150'--;

line 6, change "various" to --variable--;

line 8, change "various" to --variable--;

line 17, claim 1, after "exchange", insert --,--;

line 19, claim 1, after "and", insert --also having--; and line 49, claim 1, change "different" to --difference--.

UNITED STATES PATENT AND TRADEMARK OFFICE

CERTIFICATE OF CORRECTION

PATENT NO. : 5,005,370

DATED : April 9, 1991

INVENTOR(S) : H. Tanaka et al.

It is certified that error appears in the above-identified patent and that said Letters Patent is hereby corrected as shown below:

Col. 18, line 32, claim 2, after "is", insert --,--;

line 33, claim 2, delete "which" and after "ΔP" (second occurrence), insert --,--; and line 34, claim 2, delete "that is" and after "superheat", insert --,--.

Col. 19, line 3, claim 3, change "thermal" to --thermostatic--;

line 27, claim 5, after "exchange", insert --,--; and line 29, claim 5, after "and", insert --also having--.

Col. 20, line 9, claim 5, after "wherein", insert --the--;

line 24, claim 5, change "degrees" to --degree--;

line 51, claim 6, after "is", insert --,--;

line 52, claim 6, change "which is" to --,--; and line 53, claim 6, after "superheat", insert --,--.

UNITED STATES PATENT AND TRADEMARK OFFICE

CERTIFICATE OF CORRECTION

PATENT NO. : 5,005,370

DATED : April 9, 1991

INVENTOR(S) : H. Tanaka et al.

It is certified that error appears in the above-identified patent and that said Letters Patent is hereby corrected as shown below:

Col. 22, line 8, claim 7, before "said", insert --wherein--; and line 19, claim 8, change "a" to --the--.

Signed and Sealed this

Seventeenth Day of March, 1992

*Attest:*

HARRY F. MANBECK, JR.

*Attesting Officer*

*Commissioner of Patents and Trademarks*